US012435945B2

(12) United States Patent
Shamblen

(10) Patent No.: US 12,435,945 B2
(45) Date of Patent: Oct. 7, 2025

(54) ARCHERY BOW ECCENTRIC ALIGNMENT AND RELATED APPARATUSES

(71) Applicant: Hoyt Archery, Inc., Salt Lake City, UT (US)

(72) Inventor: Kevin T. Shamblen, West Jordan, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 162 days.

(21) Appl. No.: 18/242,409

(22) Filed: Sep. 5, 2023

(65) Prior Publication Data

US 2025/0075996 A1 Mar. 6, 2025

(51) Int. Cl.
*F41B 5/14* (2006.01)
*F41B 5/10* (2006.01)

(52) U.S. Cl.
CPC ..... *F41B 5/105* (2013.01); *F41B 5/14* (2013.01); *F41B 5/1403* (2013.01)

(58) Field of Classification Search
CPC ..... F41B 5/105; F41B 5/10; F41B 5/1403; F41B 5/14
USPC ..... 124/86, 1
See application file for complete search history.

(56) References Cited

U.S. PATENT DOCUMENTS 4,561,413 A * 12/1985 Jennings ..... F41B 5/105 124/25.6
4,739,744 A * 4/1988 Nurney ..... F41B 5/105 124/90
11,536,532 B1 * 12/2022 Grace ..... F41B 5/1403
2014/0041645 A1 * 2/2014 Wasilewski ..... F41B 5/1426 124/89
2023/0113520 A1 * 4/2023 Grace ..... F41B 5/1403 124/25.6
2023/0358501 A1 * 11/2023 Hansen ..... F41B 5/1403

* cited by examiner

*Primary Examiner* — John E Simms, Jr.

(57) ABSTRACT

A member for an archery bow having an axle, a limb, and a cam. The member contacts the axle to retain the cam at a location relative to the axle and the limb. In some examples, the member can have a shim portion positioning the cam a distance from the limb or from a first end of the axle. In some examples, the member can define a first surface facing the limb and a second surface facing the limb. In some examples, the member can have an engagement portion coupling the member to at least one of the first end of the axle or the limb. In some examples, the member can include a nesting feature receivable within a groove of the cam.

13 Claims, 21 Drawing Sheets

ARCHERY BOW ECCENTRIC ALIGNMENT AND RELATED APPARATUSES

TECHNICAL FIELD

The present disclosure generally relates to archery equipment and specifically relates to members aligning eccentrics on an archery bow.

BACKGROUND

Archery equipment, such as recurve bows, crossbows, and compound bows, are regularly used to launch arrows and other projectiles down range at one or more targets. Components of the archery bow work in unison to provide accurate and repeatable arrow flight while also providing a desirable user experience (e.g., satisfactory vibration and sound characteristics). Archery accessories, such as a sight, can be affixed to the archery bow to increase utility and directly impact user satisfaction. Components and accessories for archery bows can be improved to advantageously impact an archer's shooting experience, performance, and overall satisfaction with the archery equipment.

SUMMARY

One aspect of the present disclosure relates to an archery bow comprising a riser, a limb, a cam, and a member. The limb can extend from the riser. The cam is rotatably coupled to the limb by an axle. The member contacts the axle and has a shim portion positioning the cam a distance from the limb. The member defines a first surface facing the limb and a second surface facing the limb. The first surface is different from the second surface.

In some examples, the first surface can face a lateral surface of the limb and the second surface can face a tensile surface or a compressive surface of the limb. In some examples, the first surface can extend perpendicularly relative to the second surface. In some examples, the axle can include a groove and a portion of the member can be disposed within the groove. In some examples, the archery bow can further include a fastener coupling the second surface to a tensile surface or a compressive surface of the limb. In some examples, the member can define a first end contacting the axle at a first location. The member can define a second end contacting the axle at a second location. The first location can be spaced a distance from the second location along a length of the axle. The distance can be at least equivalent to a width of the limb.

In some examples, the member can include a mount portion coupled to the limb. The shim portion can be repositionable relative to the mount portion. In some examples, the limb can be a first limb and the member can be a first member having a first shim portion. The archery bow can further include a second limb extending from the riser and a second member contacting the axle. The second member can have a second shim portion displacing the cam a distance from the second limb. The second member can define a third surface facing the second limb and a fourth surface facing the second limb. The third surface is different from the fourth surface. The first shim portion can have a first thickness and the second shim portion can have a second thickness less than the first thickness.

Another aspect of the disclosure relates to an archery bow including a riser, a limb, an axle, a cam, and a member. The limb extends from the riser. The axle is coupled to the limb. The axle has a first end and a second end. The cam is rotatable about the axle. The member includes a shim portion and an engagement portion. The shim portion locates the cam a distance from the first end of the axle. The engagement portion couples the member to at least one of the first end of the axle or the limb.

In some examples, the member can include an intermediate portion disposed between the shim portion and the engagement portion. The intermediate portion can face a tensile surface or a compressive surface of the limb. In some examples, the engagement portion can define an aperture. The engagement portion can be coupled to the axle by a fastener extending through the aperture. The member can be partially disposed within a groove in the axle. In some examples, the shim portion can include a spacing feature having an arcuate segment and a linear segment.

Yet another aspect of the present disclosure relates to an archery bow including a riser, a limb, an axle, a cam, and a member. The limb extends from the riser. The axle is coupled to the limb. The axle has a groove disposed between a first end and a second end of the axle. The cam is rotatable about the axle. The member contacts the axle and is disposed between the cam and the limb. The member includes a main body, a shim portion, and a nesting feature. The nesting feature is receivable within the groove.

In some examples, the main body has a first thickness and the shim portion has a second thickness. A maximum thickness of the member can be defined by a summation of the first thickness and the second thickness. In some examples, the groove can extend around a circumference of the axle. In some examples, the nesting feature can be disposed within an aperture defined by the main body.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1A:
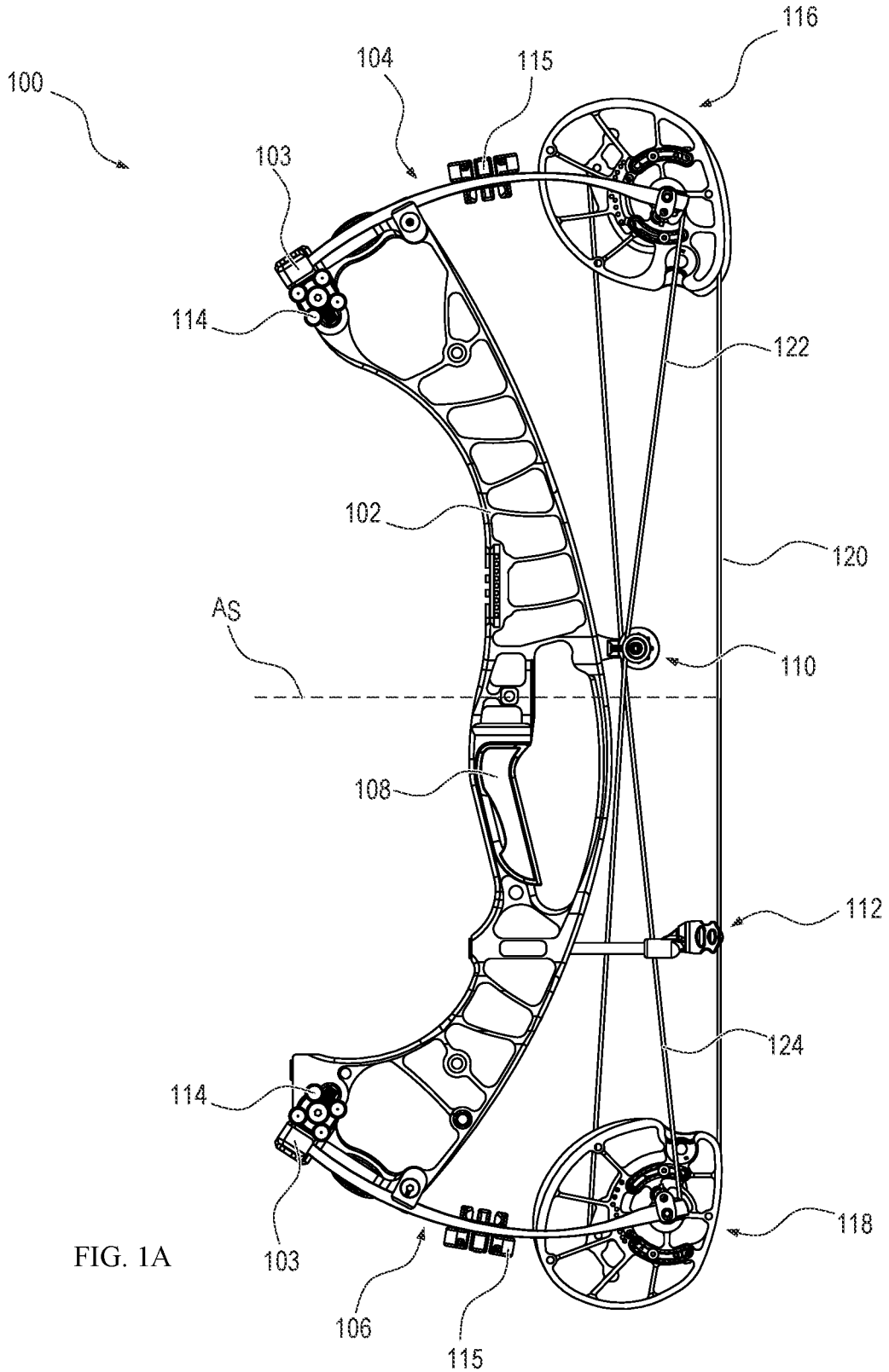
FIG. 1A is a side view of an archery bow, according to some embodiments.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

An archery bow can include one or more limbs coupled to one end of a riser and one or more limbs coupled to another end of the riser. For example, an archery bow can have a pair or set of limbs coupled to one end of the riser. The pair of limbs can define a gap or space accommodating a cam rotatably coupled between the limbs via an axle. Modifying the spacing between each limb and the cam within the gap can affect arrow tuning characteristics of the archery bow by manipulating cam lean and/or shifting a shooting plane of the archery bow. Replacing spacers between the cam and the respective limbs can require completely or partially removing the cam and/or axle from the limbs. Removing the axles can be a cumbersome and tedious process, sometimes requiring specialized tools, that does not allow an archer to easily and quickly adjust cam spacing without investing substantial time, energy, and expertise in disassembling and reassembling at least a portion of the archery bow.

One aspect of the present disclosure generally relates to a member for an archery bow which enables an archer to reposition a shooting plane of the bow by varying a spacing of eccentrics or cams relative to limbs of the archery bow in a relatively straightforward manner. In some examples, a set of members can be swapped or replaced without removing the axle or cam from the limbs. The archery bow can include a riser, a limb, a cam, and a member. The limb can extend from the riser and the cam can be rotatably coupled to the limb by an axle. The member can engage the axle such that a shim portion of the member displaces or positions the cam a distance from the limb. For example, the shim portion can act as a spacer disposed between the limb and the cam. The distance the shim portion displaces the cam from the limb can correlate to a position of the shooting plane. Thus, varying the distance can enable an archer to modify the shooting plane of the archery bow. In some examples, the members can be replaceable such that a member having a shim portion of a particular thickness can be replaced with a different member having a shim portion with a different thickness to vary the distance or spacing of the eccentric or cam relative to the limbs. Additionally, or alternatively, in some examples, the members can be swappable such that respective positions of a set of members can be swapped to vary the spacing of eccentrics or cams relative to limbs and thereby shift the shooting plane of the archery bow.

In some examples, each member can include various portions (e.g., shim portions, engagement portions, intermediate portions, etc.) which extend along two or more surfaces of the limb when the member is coupled to the archery bow. The portions can be respective sections of the member that define a first limb-facing surface (i.e., a first surface) and a second limb-facing surface (i.e., a second surface). In some examples, the first surface or first limb-facing surface can abut or extend adjacent to a lateral or side surface of the limb. In some examples, the second surface or second limb-facing surface can abut or extend adjacent to a tensile or compressive surface of the limb.

In some examples, the member can contact the axle at multiple distinct contact points. For example, the member can have first and second ends contacting respective contact points on the axle. The first contact point can be located between respective ends of the axle. The second contact point can be at or near one of the ends of the axle. In other words, in some examples, each member can include two or more contact points that are spaced from one another along the length of the axle. In some examples, the first end of the member can engage the first contact point such that the member can be pulled away from the axle without removing the axle from the limb(s). For example, the first end can form a clip or other attachment that can be engaged at the first contact point by sliding or snapping the first end onto the axle at the first contact point. Similarly, the first end can be disengaged or removed from the axle by sliding or unclipping the first end from the first contact point of the axle.

Some archery bows couple the cam assembly (e.g., axle, spacers, cam, bearings, module, etc.) to the limbs by applying a compressive force to the limbs via one or more fasteners that are receivable within a threaded aperture on either end of the axle. This compressive force can generate an undesirable thrust load applied to the bearings of the cam. In another aspect of the present disclosure, the member can include a nesting feature that is received within and engages a groove or channel within the axle to mitigate or eliminate thrust loading exerted on one or more bearings coupled to the cam. For example, compressive forces applied to the limbs can generate a thrust load that is transferred through the member and into the axle via the engagement between the nesting feature of the member and the groove in the axle. In some examples, the nesting portion can be relatively thinner than the shim portion.

The present description provides examples, and is not limiting of the scope, applicability, or configuration set forth in the claims. Thus, it will be understood that changes may be made in the function and arrangement of the members and/or other elements of the archery bow discussed without departing from the spirit and scope of the disclosure, and various embodiments may omit, substitute, or add other procedures or components as appropriate. For instance, features described with respect to certain embodiments may be combined in other embodiments. The specific examples shown in the figures and described herein should not, therefore, be considered to limit the breadth of possible embodiments and combinations of possible embodiments contemplated by the present disclosure.

Referring now to the figures in detail, FIG. 1A shows a compound archery bow 100. The archery bow 100 is at a rest position (e.g., a brace state or brace position). The archery bow 100 can comprise a riser 102 from which one or more upper limbs 104 (e.g., first limb 104A and second limb 104B) and one or more lower limbs 106 extend. For example, the upper limbs 104 can be affixed to the riser 102 by one or more limb pockets 103. The archery bow 100 can include a handle portion or grip 108, a roller guard or cable guard 110, a string-stop damper 112, riser dampers 114, limb dampers 115, and other components.

The upper limbs 104 may be connected to an upper cam assembly 116, and the lower limbs 106 may be connected to a lower cam assembly 118. A bowstring 120 (i.e., draw string) may extend across the length of the archery bow 100 between the upper cam assembly 116 and the lower cam assembly 118. The terminal ends of the bowstring 120 may be attached to and held entrained to the cam assemblies 116, 118, at least in the brace position, and the limbs 104, 106 may be flexed to store energy and retain tension in the bowstring 120. A first cable 122 and a second cable 124 may also be attached to and extend between the upper cam assembly 116 and the lower cam assembly 118. Collectively, the first cable 122 and the second cable 124 may be referred to herein as the cables of the archery bow 100. The first and second cables 122, 124 may retain tension in the limbs 104, 106 and cam assemblies 116, 118 and may be controlled to adjust tension in the bowstring 120.

The figures illustrate example archery apparatuses that may be used in conjunction with the principles and teachings of the present disclosure. Thus, while the archery bows described herein are compound bows, it will be understood by those having ordinary skill in the art that the components of the archery bow, accessories, and related methods and apparatuses included in embodiments of the present disclosure may be applied to components and apparatuses in compound bows, crossbows, their accessories, and other equipment related to archery. Similarly, archery equipment applying the teachings of the present disclosure does not need to implement all of the features of the present disclosure. For example, in some embodiments, the archery bow may not comprise a cable guard 110 or a string-stop damper 112, so features associated with those accessories may be omitted from the archery bow 100.

When shooting an arrow, the tail end of the arrow may be nocked with the bowstring 120 at a nocking point (not shown) while the archery bow 100 is in the brace position shown in FIG. 1A. The bowstring 120 may be drawn rearward to a full draw position, thereby partially unraveling the bowstring 120 from the outer grooves of the cam assemblies 116, 118. The archer may grasp the grip 108 of the riser 102 and draw back the bowstring 120 (e.g., by using a D-loop, not shown). As the limbs 104, 106 flex inward and the cables 122, 124 wind around the cam assemblies 116, 118, the cables 122, 124 may slide along or may be in rolling contact with portions of the cable guard 110, which may comprise at least one roller or other smooth support in contact with the cables 122, 124 where they contact the cable guard 110.

When the bowstring 120 is released, the potential/stored energy in the limbs 104, 106 is released, and the bowstring 120 quickly accelerates back toward the brace position (shown in FIG. 1A) as it applies a shooting force to an end of the projectile (e.g., an arrow). As the limbs 104, 106 release their energy, the cam assemblies 116, 118 are spread apart, and the terminal ends of the bowstring 120 wrap around the cam assemblies 116, 118, and the cables 122, 124 unwind from the cam assemblies 116, 118. A portion of the bowstring 120 may contact the string-stop damper 112, which can help dampen vibrations in the bowstring 120, and the cables 122, 124 may roll or slide against the cable guard 110 as the cam assemblies 116, 118 move. After returning to the brace condition, the arrow is launched from the archery bow 100 along a shooting axis $A_S$. The shooting axis $A_S$ and the bowstring 120 can define a shooting plane $P_S$ (see FIGS. 1C-1E). A position of the shooting plane $P_S$ between the upper limbs 104 and/or the lower limbs 106 can influence the efficiency of arrow flight (e.g., affect how the arrow is departs the bowstring 120 and launches from the archery bow 100).

Figure 1B:
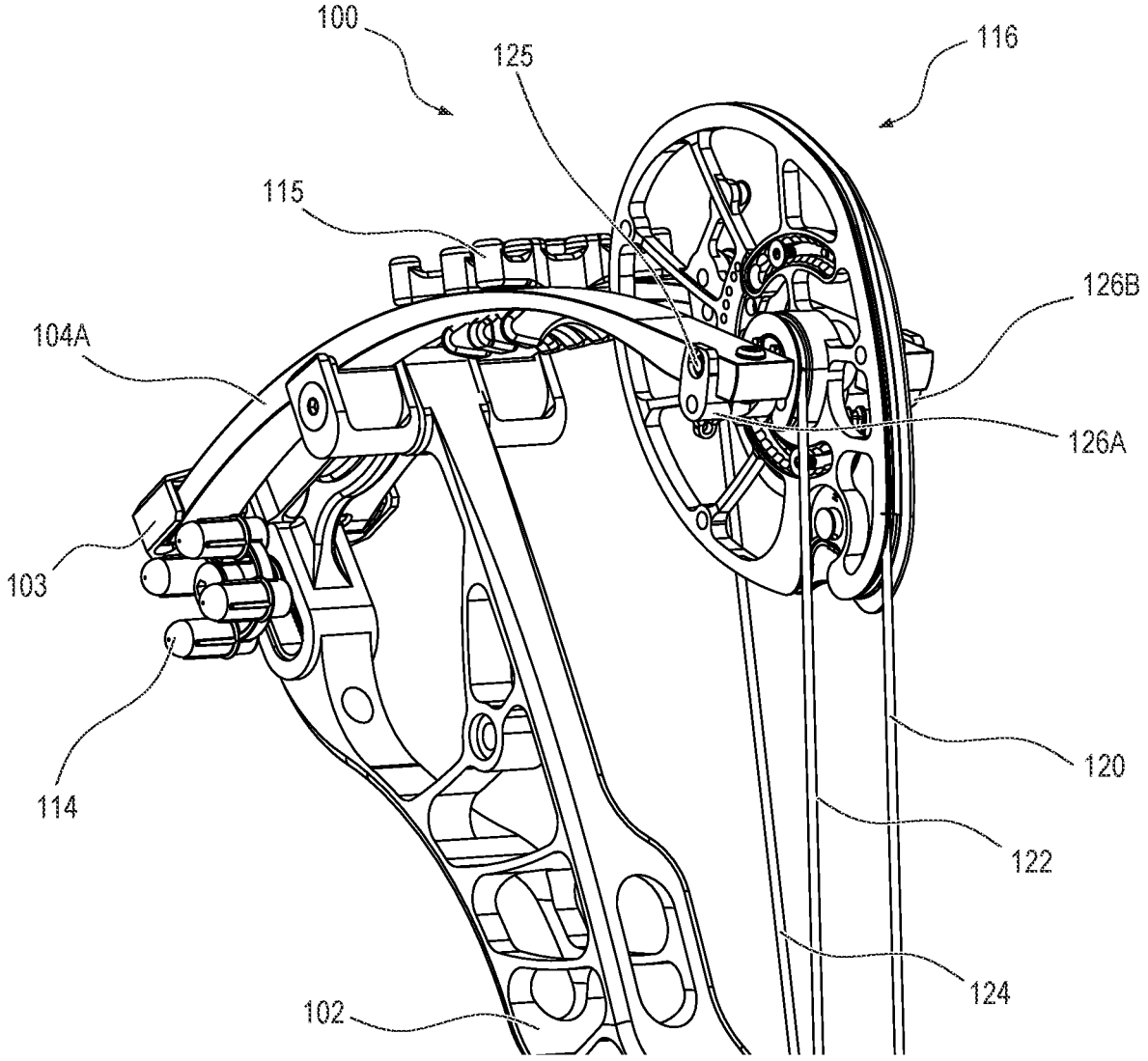
FIG. 1B is a perspective detail rear view of the archery bow, according to some embodiments.
Figure 1C:
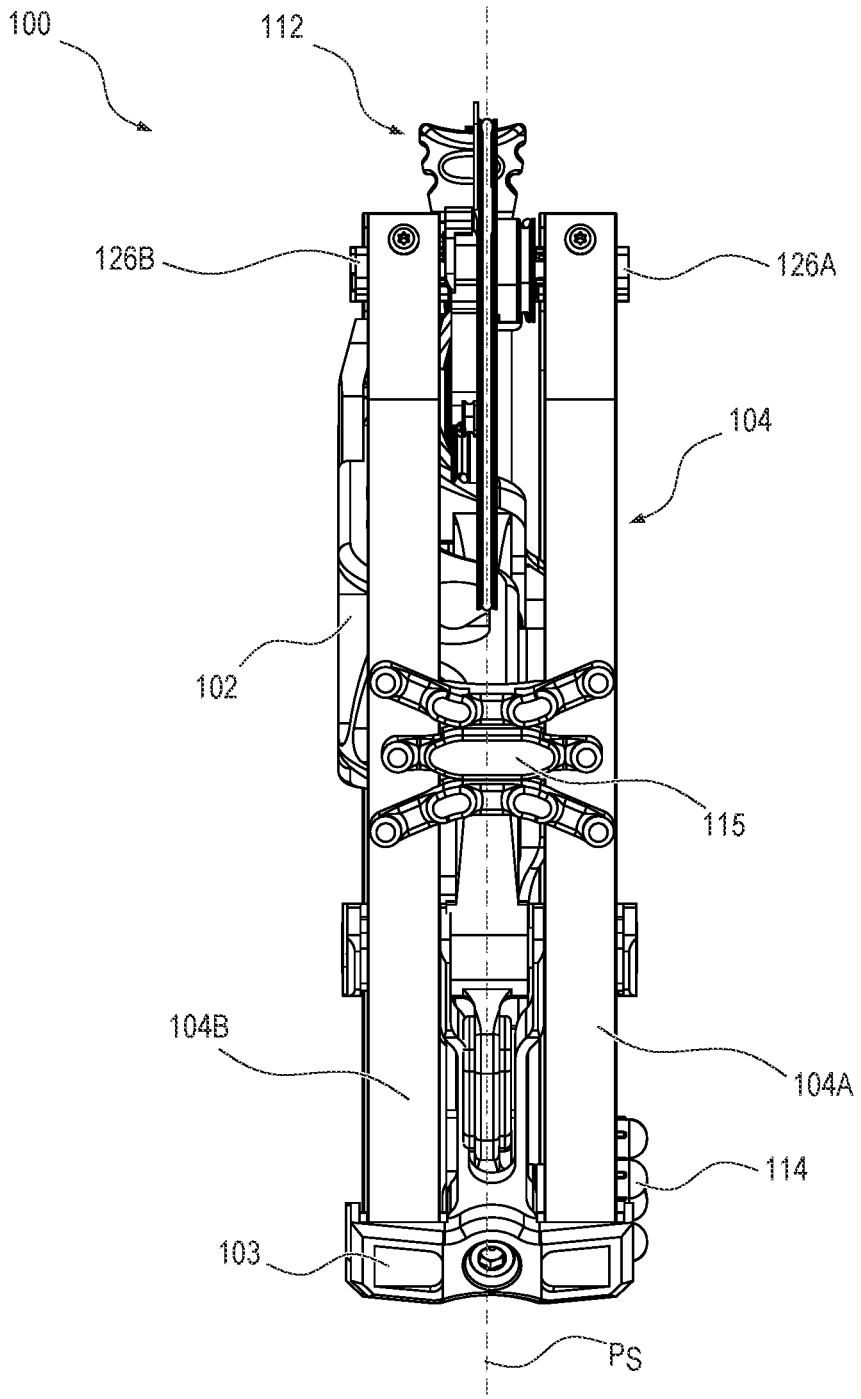
FIG. 1C is a detail top view of the archery bow, according to some embodiments.

FIG. 1B and FIG. 1C show the upper cam assembly 116 rotatably coupled to the first and second limbs 104A, 104B (e.g., upper limbs 104). In some examples, the upper cam assembly 116 is rotatably coupled to the first and second limbs 104A, 104B by an axle 125 (see e.g., axle 230 in FIG. 2E). In some examples, a set or pair of members can displace or space the upper cam assembly 116 between the first and second limbs 104A, 104B. For example, the upper cam assembly 116 can be displaced or spaced from the first limb 104A by a first member 126A. The upper cam assembly 116 can be displaced or spaced from the second limb 104B by a second member 126B. In other words, at least a portion of the first and second members 126A, 126B can act as spacers disposed between the upper cam assembly 116 and the respective first and second limbs 104A, 104B to locate the upper cam assembly 116 relative to the first and second limbs 104A, 104B.

In some examples, each of the first and second members 126A, 126B can be coupled to the axle 125. Additionally, or alternatively, one or both of the first and second members 126A, 126B can be coupled to the first or second limbs 104A, 104B. For example, the first member 126A can be affixed, fastened, or otherwise coupled to the first limb 104A. Similarly, the second member 126B can be affixed, fastened, or otherwise coupled to the second limb 104B. In some examples, the first member 126A can be removed from the first limb 104A and/or the axle 125 and affixed to the second limb 104B while the second member 126B can be removed from the second limb 104B and/or axle 125 and affixed to the first limb 104A (see FIG. 1D and FIG. 1E).

A position or location at which the upper cam assembly 116 is held on the axle 125 relative to the first and second limbs 104A, 104B by the first and second members 126A, 126B can correlate to a position or location of the shooting plane $P_S$. The opportunity for an archer or bow technician to manipulate the lateral position of the shooting plane $P_S$ relative to the upper limbs 104 can affect arrow tuning characteristics of the archery bow 100. While not depicted in FIGS. 1B-1E, in some examples, the lower cam assembly 118 can be repositionable relative to the lower limbs 106 by one or more respective members substantially similar to, including some or all of, the features of the first and second members 126A, 126B. Thus, in some examples, both the upper and lower cam assemblies 116, 118 can be laterally manipulated relative to their respective limbs to adjust the shooting plane $P_S$ of the archery bow 100.

Figure 1D:
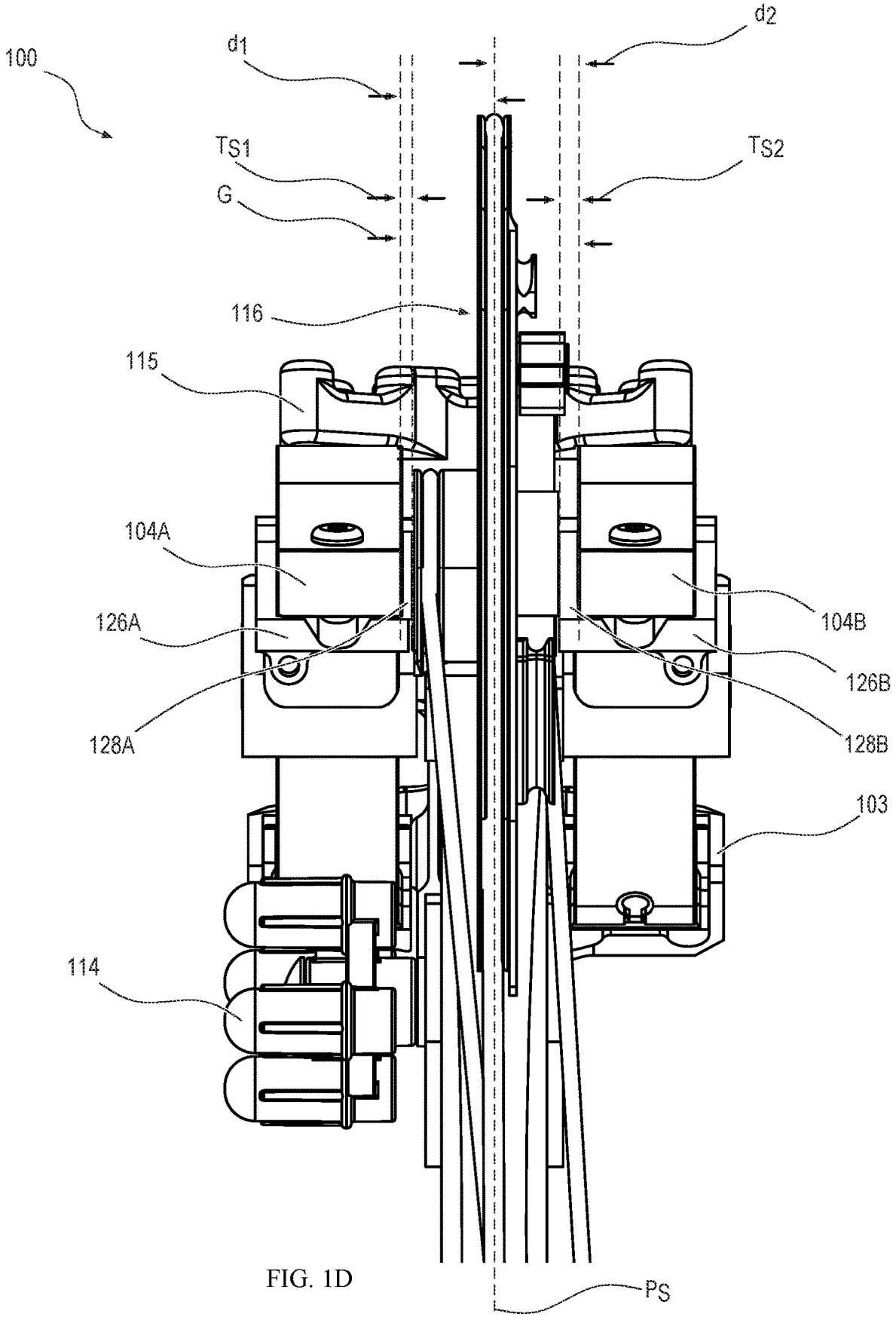
FIG. 1D is a detail rear view of the archery bow in a first configuration, according to some embodiments.

FIG. 1D shows the first and second members in a first configuration wherein the shooting plane $P_S$ is displaced a first distance $d_1$ from the first limb 104A and the displaced a second distance $d_2$ from the second limb 104B. In some examples, the first distance $d_1$ can be relatively lesser or smaller than the second distance $d_2$ such that the shooting plane $P_S$ is located or disposed relatively closer to the first limb 104A than the second limb 104B. In some examples, the first distance $d_1$ can be relatively greater or larger than the second distance $d_2$ such that the shooting plane $P_S$ is located or disposed relatively closer to the second limb 104B than the first limb 104A. In some examples, the first distance $d_1$ can be equal to or substantially equal to the second distance $d_2$ such that the shooting plane $P_S$ is located or disposed at a midpoint between a gap $G_0$ between the first limb 104A and the second limb 104B.

In the first configuration (shown in FIG. 1D), the first member 126A can be affixed to the first limb 104A and/or coupled to the axle 125 adjacent to the first limb 104A. In the first configuration, the second member 126B can be affixed to the second limb 104B and/or coupled to the axle 125 adjacent to the second limb 104B. In the first configuration, the upper cam assembly 116 can be displaced from the first limb 104A by a first shim thickness $T_{S1}$ and displaced from the second limb 104B by a second shim thicknesses $T_{S2}$. The first and second shim thicknesses $T_{S1}$, $T_{S2}$ can be defined by a portion of each member 126A, 126B disposed between the upper cam assembly 116 and each respective upper limb 104A, 104B. For example, the first shim thickness $T_{S1}$ can be defined by a first shim portion 128A of the first member 126A and the second shim thickness $T_{S2}$ can be defined by a second shim portion 128B of the second member 126B. In some examples, the first shim thickness $T_{S1}$ can be relatively lesser or smaller than the second shim thickness $T_{S2}$ such that the upper cam assembly 116 is located or disposed relatively closer to the first limb 104A than the second limb 104B. In the first configuration, the first distance $d_1$ can be less than the second distance $d_2$ such that the shooting plane $P_S$ is relatively closer to the first limb 104A than the second limb 104B. In some examples, the first shim thickness $T_{S1}$ can be less than about 0.015 inches, between about 0.015 inches and about 0.05 inches, between about 0.05 inches and about 0.1 inches, between about 0.1 inches and about 0.15 inches, between about 0.15 inches and about 0.25 inches, between about 0.25 inches and about 0.35 inches, or greater than 0.35 inches. In some examples, the second shim thickness $T_{S2}$ can be less than about 0.015 inches, between about 0.015 inches and about 0.05 inches, between about 0.05 inches and about 0.1 inches, between about 0.1 inches and about 0.15 inches, between about 0.15 inches and about 0.25 inches, between about 0.25 inches and about 0.35 inches, or greater than 0.35 inches.

Figure 1E:
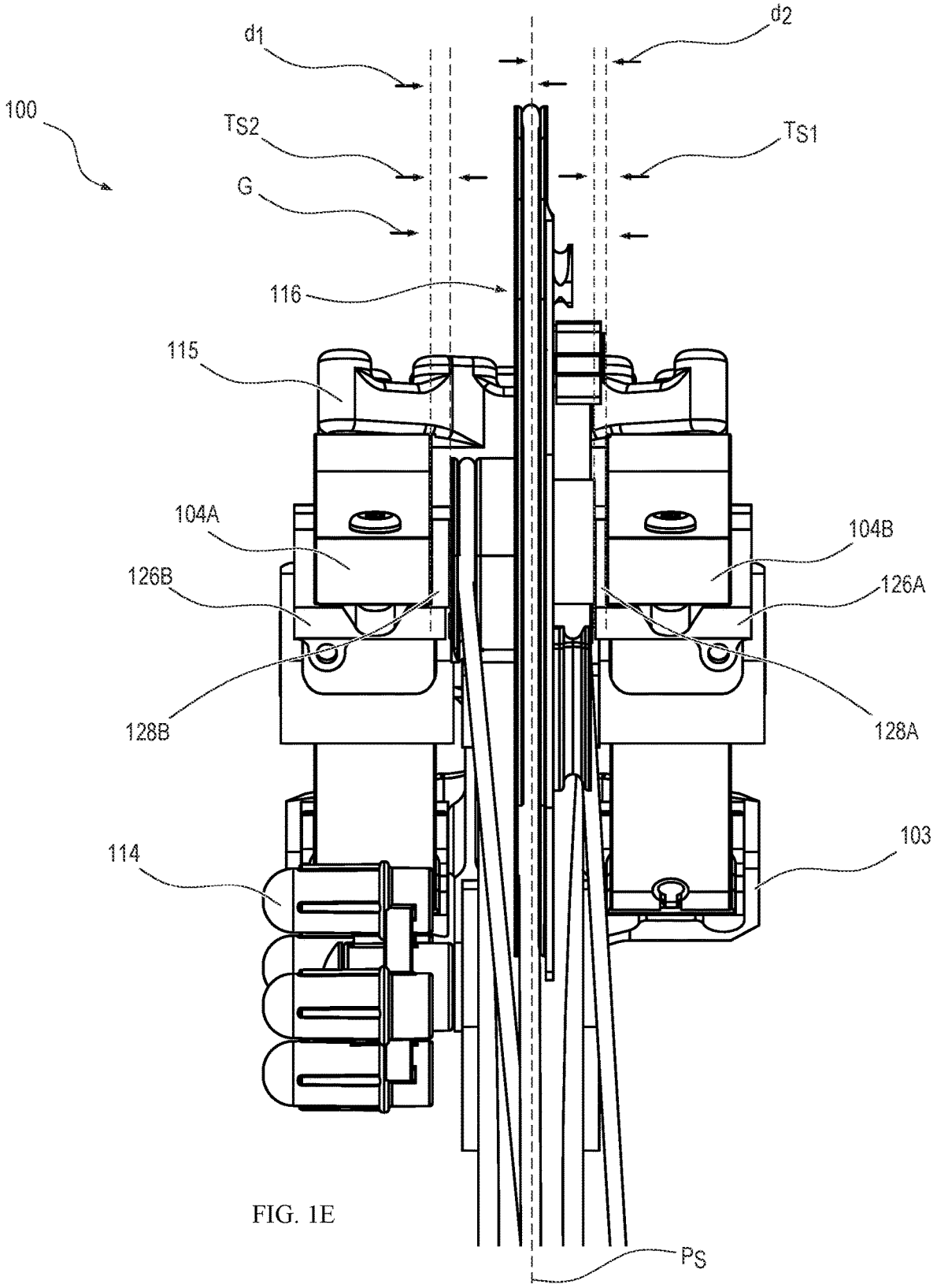
FIG. 1E is a detail rear view of the archery bow in a second configuration, according to some embodiments.

In a second configuration, shown in FIG. 1E, the first member 126A can be affixed to the second limb 104B and/or coupled to the axle 125 adjacent to the second limb 104B. In the second configuration, the second member 126B can be affixed to the first limb 104A and/or coupled to the axle 125 adjacent to the first limb 104A. In other words, in the second configuration, the position of the first and second members 126A, 126B on the first and second limbs 104A, 104B, respectively, are swapped compared to the first configuration. As such, the upper cam assembly 116 can be displaced from the first limb 104A by the second shim thickness $T_{S2}$ and displaced from the second limb 104B by the first shim thicknesses $T_{S1}$. In some examples, the first shim thickness $T_{S1}$ can be relatively lesser or smaller than the second shim thickness $T_{S2}$ such that the upper cam assembly 116 is located or disposed relatively closer to the second limb 104B than the first limb 104A. In the second configuration, the first distance $d_1$ can be greater than the second distance $d_2$ such that the shooting plane $P_S$ is relatively further from the first limb 104A than the second limb 104B. The members 126A, 126B will be further described below with reference to FIGS. 2A-2I.

FIGS. 2A-2D shows a member 200 that is substantially similar to, and can include some or all of the features of the members 126A, 126B. For example, the member 200 can be affixed to an axle and/or a limb of an archery bow to displace or locate a cam of the archery bow relative to the limb. In some examples, the member 200 can include one or more portions, such as, a shim portion 202, an intermediate portion 204, and/or an engagement portion 206. In some examples, one or more of these portions can be integrally formed from a continuous material, such as, a singular or unitary molded or machined component. In some examples, one or more of these portions can be discretely formed and thereafter welded, adhered, fastened, or otherwise coupled together to form the member 200.

The shim portion 202 can extend from the intermediate portion 204 to at least partially position the shim portion 202 between a limb (e.g., limb 104A) and a cam assembly (e.g., cam assembly 116) of the archery bow. For example, the shim portion 202 can extend substantially perpendicular from the intermediate portion 204 such that the shim portion 202 and the intermediate portion 204 generally form a right angle. In other examples, the shim portion 202 can extend from the intermediate portion 204 to form an angle less than 90 degrees or greater than 90 degrees.

Figure 2A:
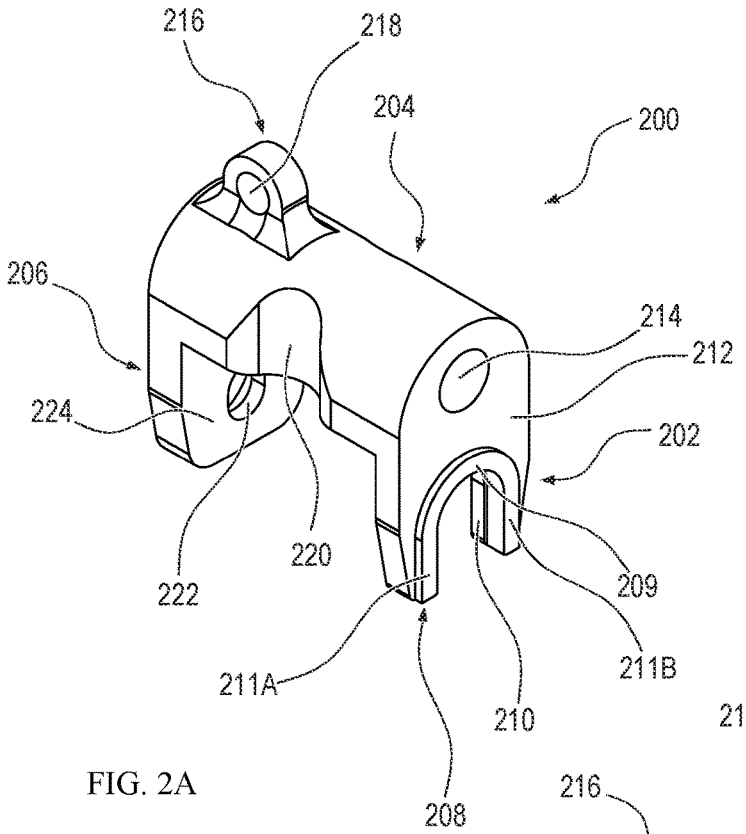
FIG. 2A is a perspective side view of a member, according to some embodiments.
Figure 2B:
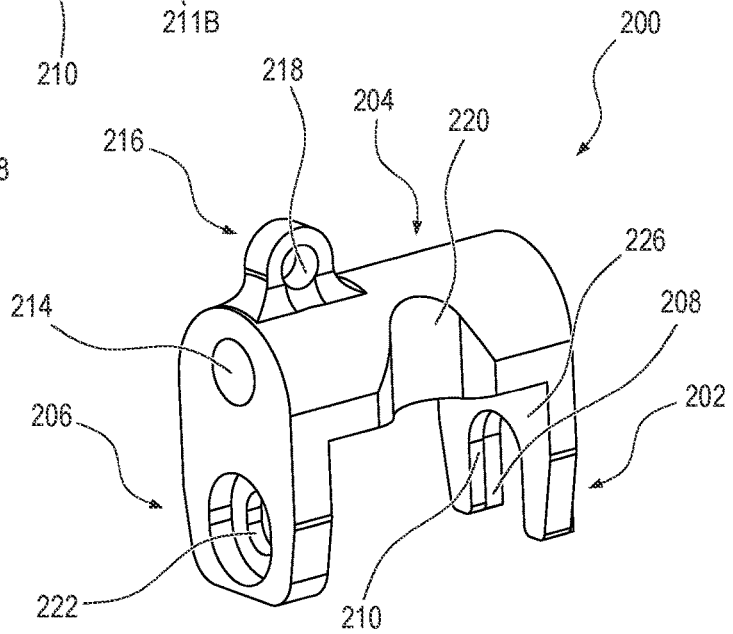
FIG. 2B is a perspective side view of the member, according to some embodiments.

In some examples, the shim portion 202 includes a spacing feature 208 and a nesting feature 210. The spacing feature 208 can be arranged and positioned on the shim portion 202 such that the spacing feature 208 is the only section of the shim portion 202 that contacts an inner race of a cam bearing leaving the remainder of the cam bearing to freely rotate about the axle. In some examples, as shown in FIG. 2D, the spacing feature 208 can define or form a section of the shim portion 202 that is relatively thicker or wider than a section of the shim portion 202 disposed adjacent the intermediate portion 204. In other words, the spacing feature 208 can extend or protrude from a lateral surface 212 of the shim portion 202 to space or displace the cam from the lateral surface 212. The spacing feature 208 can be disposed about a portion of the shim portion 202 located adjacent to the axle (see FIGS. 2G-2H) while the member 200 is affixed to the axle. In some examples, the spacing feature 208 can be formed from one or more arcuate segments and linear segments. For example, the spacing feature 208 can include a single arcuate segment 209 that transitions into two linear segments 211A, 211B that extend parallel to one another.

The nesting feature 210 can be defined as a protrusion or extension disposed within a concavity or recessed structure defined by the shim portion 202. For example, the concavity or recessed structure can be u-shaped or otherwise open-ended such that the shim portion 202 can be at least partially disposed about the axle (see FIGS. 2G-2J) and the nesting feature 210 can be at least partially insertable into a groove or channel (see 232A, 232B at FIGS. 2E and 2F) formed within the axle (see FIG. 2E and FIG. 2F). While the nesting feature 210 is disposed within the groove or channel of the axle, a potential thrust load on the bearing can be mitigated or eliminated by transferring compressive loading from the member to the axle rather than a cam bearing. As such, while inserted on the axle, the member 200 can be prevented from sliding or translating along the axle due to an engagement formed between the nesting feature 210 and the groove or channel formed within the axle.

Figure 2C:
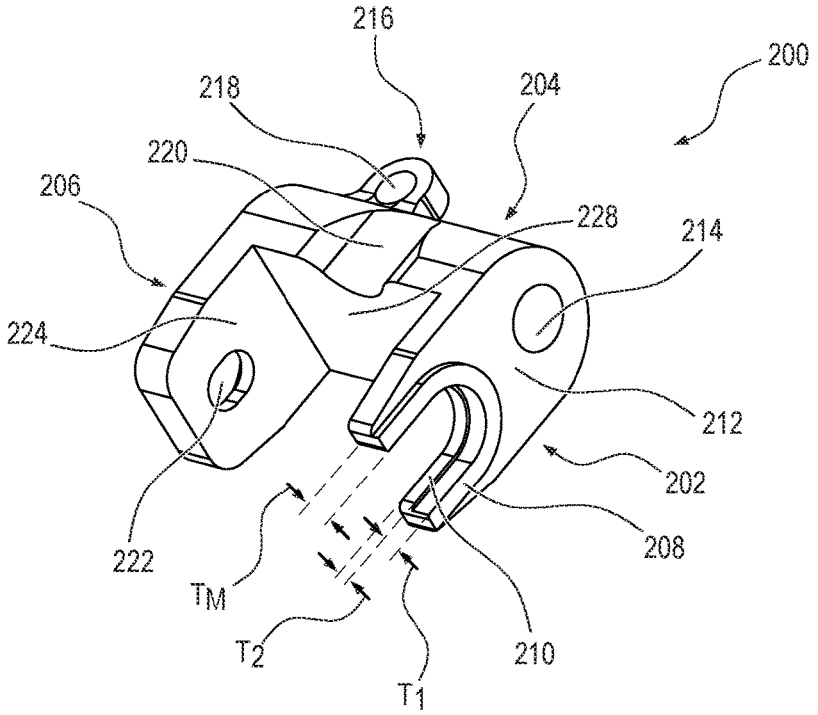
FIG. 2C is a perspective bottom view of the member, according to some embodiments.
Figure 2D:
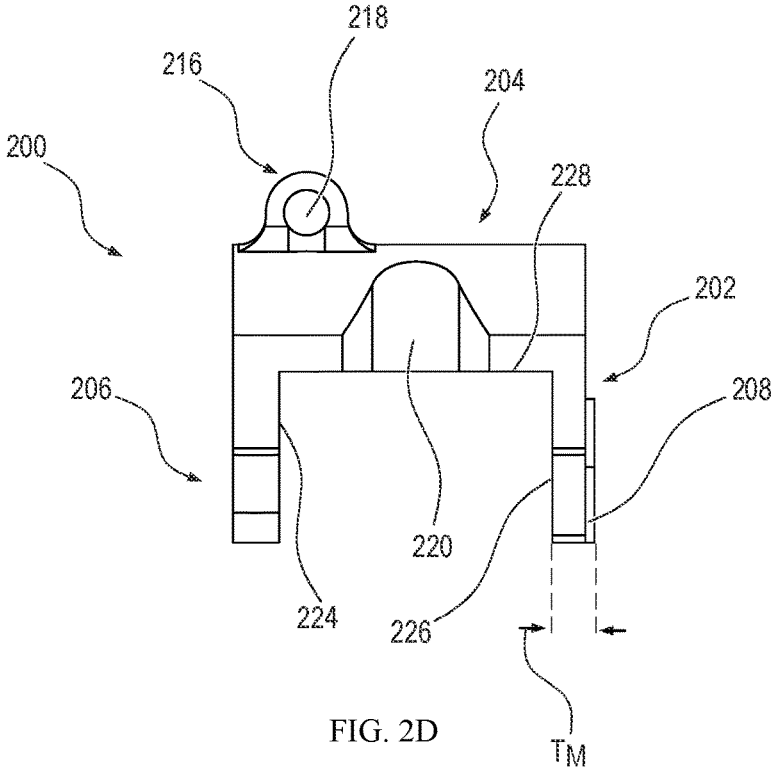
FIG. 2D is a rear view of the member, according to some embodiments.

In some examples, the spacing feature 208 can have a first thickness $T_1$ and the nesting feature 210 can have a second thickness $T_2$ (see FIG. 2C). A maximum thickness $T_M$ of the shim portion 202 can be equal to a summation of the first and second thicknesses $T_1$, $T_2$. In other words, the first and second thicknesses $T_1$, $T_2$ can define the maximum thickness $T_M$ of the shim portion 202. In some examples, the first thickness $T_1$ can be greater or larger than the second thickness $T_2$. In some examples, the first thickness $T_1$ can be lesser or smaller than the second thickness $T_2$. In some examples, the first thickness can be less than about 0.015 inches, between about 0.015 inches and about 0.05 inches, between about 0.05 inches and about 0.1 inches, between about 0.1 inches and about 0.15 inches, between about 0.15 inches and about 0.25 inches, between about 0.25 inches and about 0.35 inches, or greater than 0.35 inches. In some examples, the second thickness can be less than about 0.015 inches, between about 0.015 inches and about 0.05 inches, between about 0.05 inches and about 0.1 inches, between about 0.1 inches and about 0.15 inches, between about 0.15 inches and about 0.25 inches, between about 0.25 inches and about 0.35 inches, or greater than 0.35 inches.

In some examples, the intermediate portion 204 can extend between or span the shim portion 202 and the engagement portion 206. This extension or span can accommodate at least a portion of an archery limb disposed between the shim portion 202 and the engagement portion 206. For example, the extension or span defined by the intermediate portion 204 can be substantially equal to or greater than a width of a limb of an archery bow. In some examples, the intermediate portion 204 can include an aperture 214. The aperture 214 can extend wholly through the intermediate portion 204 in some examples. In other examples, the aperture 214 may only partially extend through the intermediate portion 204. The aperture 214 can enable an archer or archery technician to insert an object, such as a tool, into the member 200 to pry or bias the member 200 from engagement with an axle, for example, to remove one or more members 200 from an archery bow.

In some examples, the member 200 can include an accessory feature 216 enabling one or more accessories or other components to couple to the member 200. For example, a limb-driven arrow rest (not shown) can be coupled to the accessory feature 216 via a cable or cord to facilitate a drop-away functionality of the arrow rest. In some examples, the cable or cord can be tied or otherwise affixed within one or more apertures 218 defined or formed within the accessory feature 216. The aperture 218 can be one or more through-holes or blind holes. In some examples, the aperture 218 can have a relatively smooth bore. In some examples, the aperture 218 can have a bore that is threaded, partially threaded, slotted, chamfered, countersunk, counterbored, or a combination thereof. While the accessory feature 216 is shown as extending from the intermediate portion 204, the accessory feature 216 can additionally, or alternatively, be formed or defined as part of the shim portion 202 and/or the engagement portion 206 in some examples.

In some examples, the member 200 can include one or more reliefs 220, such as, the one or more reliefs 220 within the intermediate portion 204 shown in FIGS. 2A-2D. Each of the one or more reliefs 220 can provide clearance or otherwise enable access to other components of the archery bow. For example, each of the one or more reliefs 220 can enable access and removal or insertion of one or more fasteners disposable within the distal ends of each limb of the archery bow. While the one or more reliefs 220 are shown as formed within the intermediate portion 204, the one or more reliefs 220 can additionally, or alternatively, be formed or defined within the shim portion 202 and/or the engagement portion 206 in some examples.

The engagement portion 206 can extend from the intermediate portion 204 to be at least partially position adjacent to the lateral outside surface of the limb (i.e., opposite the lateral surface of the limb facing the cam) of the archery bow. For example, the engagement portion 206 can extend substantially perpendicular from the intermediate portion 204 such that the engagement portion 206 and the intermediate portion 204 generally form a right angle. In other examples, the engagement portion 206 can extend from the intermediate portion 204 to form an angle less than 90 degrees or greater than 90 degrees.

In some examples, the engagement portion 206 can include an aperture 222 enabling a user to couple the member 200 to an axle of an archery bow, for example, with a fastener (see FIGS. 2G-2I) or e-clip. The aperture 222 can be chamfered, countersunk, counterbored, threaded, keyed, or a combination thereof in some examples. For example, as shown in FIGS. 2A-2C, the aperture 222 can be a countersunk slotted through-hole extending through the engagement portion 206. In some examples, a diameter of the aperture 222 can be smaller than a diameter of the axle (see FIG. 2E and FIG. 2F) such that the axle abuts or is otherwise disposed adjacent to an internal or limb-facing surface 224 of the engagement portion 206. In other examples, a diameter of the aperture 222 can be larger than a diameter of the axle such that the axle partially extends through the aperture 222.

In some examples, each of the shim portion 202, the intermediate portion 204, and the engagement portion 206 can form or define respective limb-facing surfaces such that the member 200 includes multiple limb-facing surfaces. For example, the shim portion 202 can include a first surface or first limb-facing surface 226 and the intermediate portion 204 can include a second surface or second limb-facing surface 228. In some examples, the first limb-facing surface 226 can be adjacent to and/or face a lateral surface of the limb (e.g., a side surface of the limb that is disposed closest to the cam). In some examples, the second limb-facing surface 228 can be adjacent to and/or face a tensile surface or compressive surface of the limb (e.g., a surface of the limb disposed between the lateral or side surfaces). In some examples, the archery bow can include a second member (see member 200B in FIG. 2G) and the second member can form or define third and fourth surfaces that each face a second limb of the archery bow. The third and fourth surfaces can be different from one another.

In some examples wherein the member includes the engagement portion 206, the engagement portion 206 can form or define a third surface or third limb-facing surface (i.e., the third limb-facing surface 224). The third limb-facing surface 224 can be adjacent to and/or face a lateral surface of the limb (e.g., a side surface of the limb that is disposed furthest from the cam). Any combination of the first, second, or third limb-facing surfaces 226, 228, 224 can extend perpendicular relative to one another.

Figure 2E:
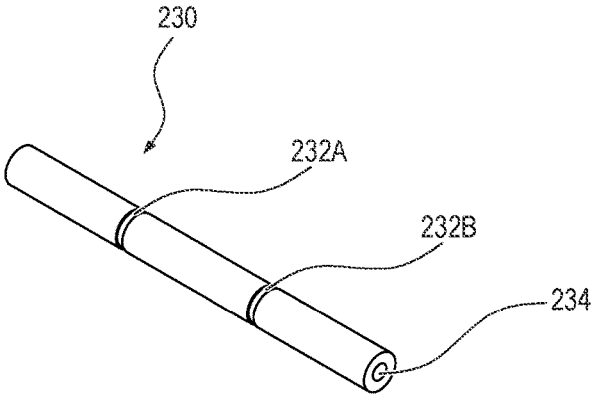
FIG. 2E is a perspective side view of an axle for an archery bow, according to some embodiments.
Figure 2F:
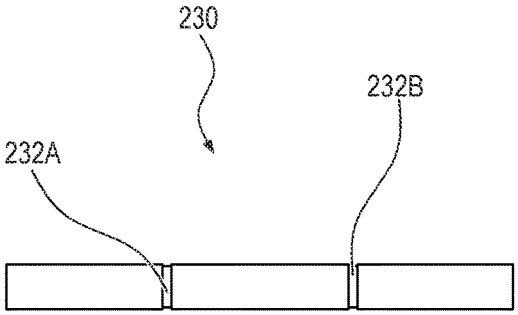
FIG. 2F is a rear view of the axle, according to some embodiments.

FIG. 2E and FIG. 2F show an axle 230 for an archery bow. The axle 230 can have one or more features that enable the axle 230 to couple to or otherwise engage one or more portions of the member 200. For example, the axle 230 can include one or more channels or grooves 232A, 232B located or positioned on the axle 230 to receive at least the nesting feature 210 of the member 200. In some examples, each of the grooves 232A, 232B can extend around a circumference of the axle 230. While the nesting feature 210 is disposed within the groove 232A, 232B of the axle 230, a potential thrust load on the cam bearing can be mitigated or eliminated by transferring compressive loading from the member 200, through the nesting feature 210, to the axle 230. As such, while inserted on the axle 230, the member 200 can be prevented from sliding or translating along the axle due to an interference formed between the nesting feature 210 and the groove 232A, 232B. Each of the distal ends of the axle 230 can include a feature for affixing a fastener (e.g., a bolt, e-clip, etc.) to the axle 230. For example, the axle 230 can include threaded apertures 234 formed at the distal ends of the axle 230.

Figure 2G:
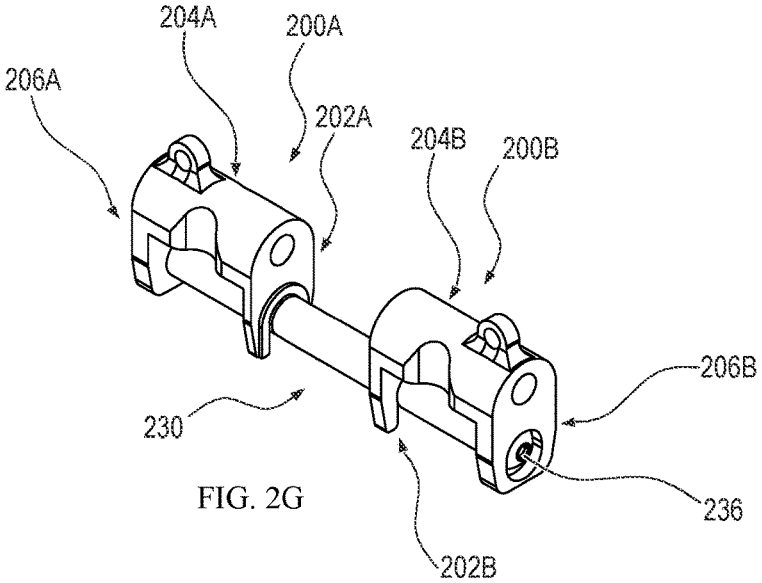
FIG. 2G is a perspective side view of a set of members on an axle for an archery bow, according to some embodiments.
Figure 2H:
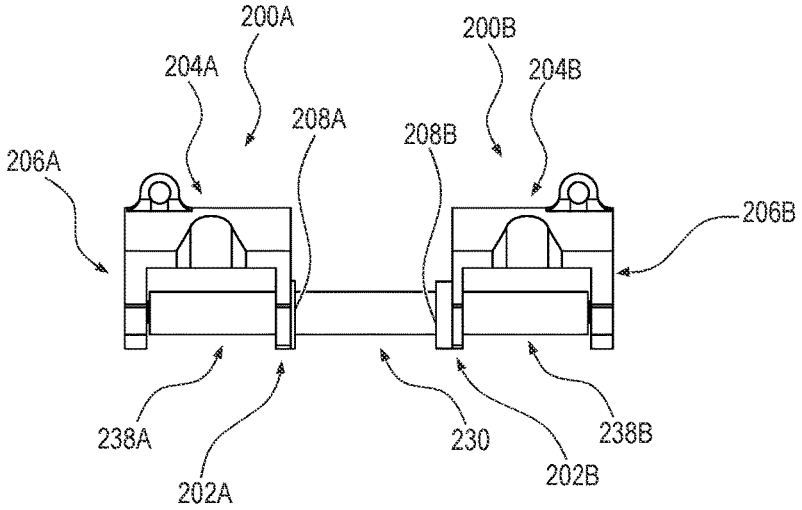
FIG. 2H is a rear view of the set of members on the axle in a first configuration, according to some embodiments.
Figure 2I:
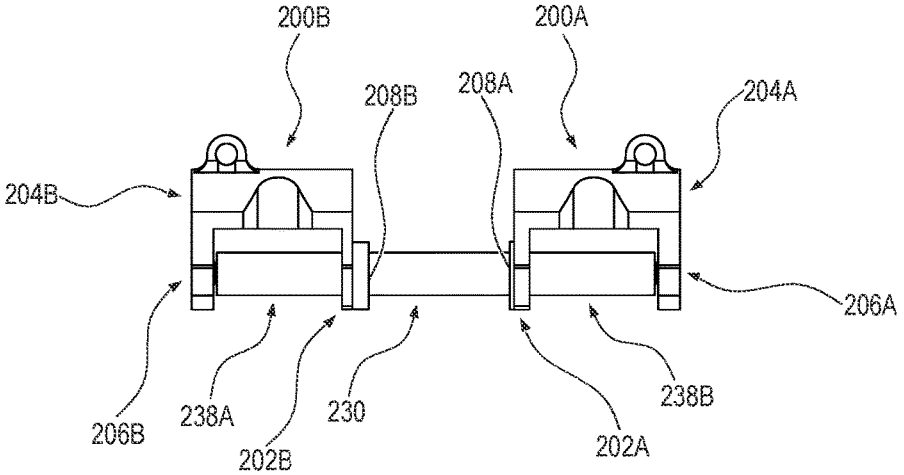
FIG. 2I is a rear view of the set of members on the axle in a second configuration, according to some embodiments.

FIGS. 2G-2I show first and second members 200A, 200B affixed or otherwise coupled to the axle 230. The first and second members 200A, 200B can be substantially similar to, and can include some or all of the features of the members 126A, 126B, 200. For example, each of the members 200A, 200B can include respective shim portions 202A, 202B, intermediate portions 204A, 204B, and engagement portions 206A, 206B. The shim portion 202A can define a first end of the member 200A contacting the axle 230 at a first location. The engagement portion 206A can define a second end of the member 200A contacting the axle 230 at a second location. The first location can be spaced a distance from the second location along a length of the axle 230. The distance can be at least equivalent to a width of a limb (e.g., the first limb 104A). The shim portion 202B can define a first end of the member 200B contacting the axle 230 at a third location. The engagement portion 206B can define a second end of the member 200B contacting the axle 230 at a fourth location. The third location can be spaced a distance from the fourth location along a length of the axle 230. The distance can be at least equivalent to a width of a limb (e.g., the second limb 104B).

In some examples, the first member 200A can be coupled to the axle 230, for example, the shim portion 202A can clamp or clip over the axle 230. Additionally, or alternatively, the nesting feature 210 can clamp or clip within the groove 232A to retain the first member 200A to the axle 230. In some examples, the engagement portion 206A can additionally, or alternatively, facilitate coupling the first member 200A to the axle 230. For example, a fastener (not shown) can be inserted through the aperture 222 within the engagement portion 206A of the first member 200A and can be threadably received within the threaded aperture 234.

In some examples, the second member 200B can be coupled to the axle 230, for example, the shim portion 202B can clamp or clip over the axle 230. Additionally, or alternatively, the nesting feature 210 can clamp, clip, or otherwise engage within the groove 232B to retain the second member 200B to the axle 230. In some examples, the engagement portion 206B can additionally, or alternatively, facilitate coupling the second member 200B to the axle 230. For example, a fastener 236 can be inserted through the aperture 222 within the engagement portion 206B of the second member 200B and can be threadably received within the threaded aperture 234.

In some examples, the shim portion 208A can locate the cam a distance from a first end of the axle 230 and the engagement portion 206A can couple the member 200A to the first end of the axle 230. The distance can be defined as spanning between the lateral edges of the member 200A (e.g., the engagement portion 206A and the shim portion 208A). In some examples, the shim portion 208B can locate the cam a distance from a second end of the axle 230 and the engagement portion 206B can couple the member 200B to the second end of the axle 230 (e.g., the engagement portion 206B and the shim portion 208B). In other words, the cam can be disposed at a location between the first and second ends on the axle 230 that is defined by the relative widths of the members 200A, 200B.

In some examples, the first and second members 200A, 200B can be swappable on the axle or otherwise repositioned on the axle 230 to vary a location a cam is retained on the axle 230 (e.g., between the first and second members 200A, 200B). In other words, the position the cam is retained on the axle 230 can be manipulated by a spacing associated with each of the first and second members 200A, 200B. Due to respective tensions within one or more cables and a bowstring of the archery bow, the cam can be biased to lean or tilt the axle 230. This lean or tilt can affect the shooting plane of the archery bow and thereby influence the accuracy of the archery bow. By repositioning or swapping the first and second members 200A, 200B, the lean or tilt of the axle 230 exerted by the cam can be mitigated or modified to improve shooting characteristics of the archery bow.

FIG. 2H shows the first and second members 200A, 200B in a first state or first configuration on the axle 230 wherein the first member 200A is coupled to a first side 238A of the axle 230 and the second member 200B is coupled to a second side 238B of the axle 230. In some examples, the first member 200A has a first spacing feature 208A having a first thickness and the second member 200B has a second spacing feature 208B having a second thickness different from the first thickness. FIG. 2I shows the first and second members 200A, 200B in a second state or second configuration on the axle 230 wherein the first member 200A is coupled to the second side 238B of the axle 230 and the second member 200B is coupled to the first side 238A of the axle 230. Due to the relative difference between the first and second thicknesses of the first and second spacing features 208A, 208B, a cam can be disposed on the axle 230 at different lateral positions dependent on which sides of the axle 230 (e.g., first and second sides 238A, 238B) the first and second members 200A, 200B are disposed. For example, in the first state or first configuration (see FIG. 2H) the cam can be disposed relatively closer to the first side 238A of the axle 230 because the relatively larger second spacing feature 208B of the second member 200B is spacing the cam further from the second side 238B of the axle 230. Conversely, in the second state or second configuration (see FIG. 2I) the cam can be disposed relatively closer to the second side 238B of the axle 230 because the relatively larger second spacing feature 208B of the second member 200B is spacing the cam further from the first side 238A of the axle 230.

Figure 3A:
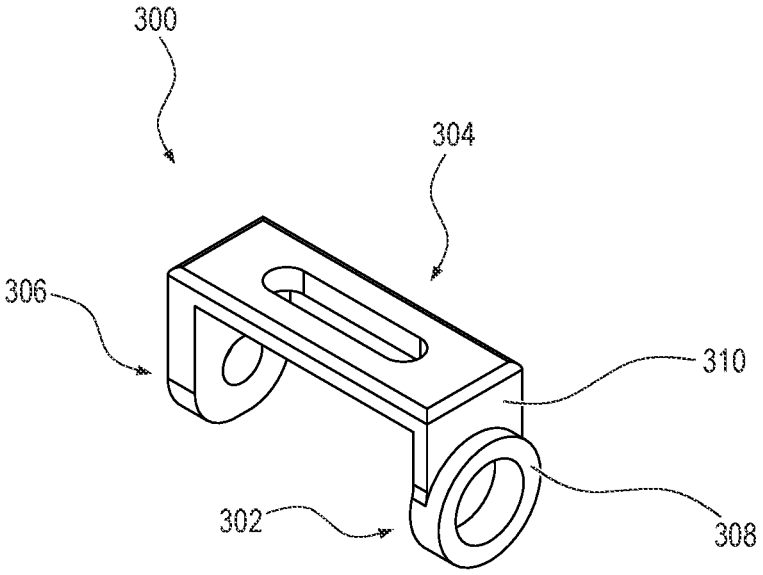
FIG. 3A is a perspective side view of a member for an archery bow, according to some embodiments.

FIG. 3A shows another example embodiment of a member 300 capable of being affixed to an axle and/or a limb of an archery bow to displace or locate a cam of the archery bow relative to the limb. In some examples, the member 300 can include one or more portions, such as, a shim portion 302, an intermediate portion 304, and/or an engagement portion 306. In some examples, one or more of these portions can be integrally formed from a continuous material, such as, a singular or unitary molded or machined component. In some examples, one or more of these portions can be discretely formed and thereafter welded, adhered, fastened, or otherwise coupled together to form the member 300.

Figure 3B:
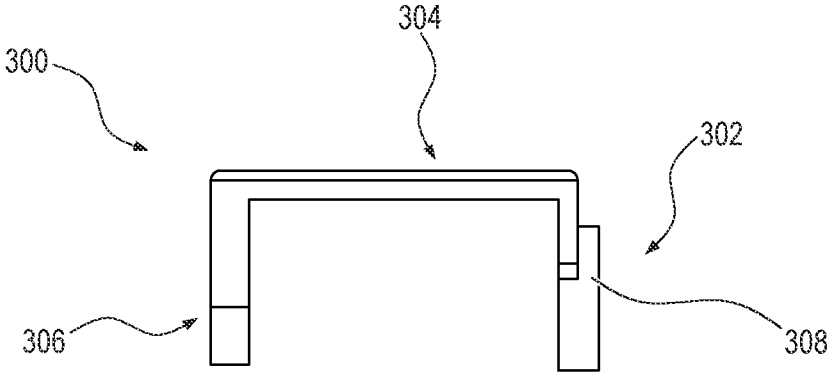
FIG. 3B is a rear view of the member, according to some embodiments.

Each of the portions (e.g., shim portion 302, intermediate portion 304, and engagement portion 306) can be similar to, and can include some or all of the features of the portions (e.g., shim portion 202, intermediate portion 204, and engagement portion 206) of the members 126A, 126B, 200. For example, the shim portion 302 can include a spacing feature 308. The spacing feature 308 can be arranged and positioned on the shim portion 302 such that the spacing feature 308 is the only section of the shim portion 302 that contacts an inner race of a cam bearing leaving the remainder of the cam bearing to freely rotate about the axle. In some examples, as shown in FIG. 3B, the spacing feature 308 can define or form a section of the shim portion 302 that is relatively thicker or wider than a section of the shim portion 302 disposed adjacent the intermediate portion 304. In other words, the spacing feature 308 can extend or protrude from a lateral surface 310 of the shim portion 302 to space or displace the cam from the lateral surface 310.

The spacing feature 308 can encircle or encompass a portion of the axle (see FIGS. 3C-3E) while the member 300 is affixed to the axle such that the member 300 is not removable from the archery bow without disassembling one or more components of the archery bow. For example, to remove the member 300, one or more limbs, cams, axles, fasteners, or combinations thereof may need to be removed beforehand.

Figure 3C:
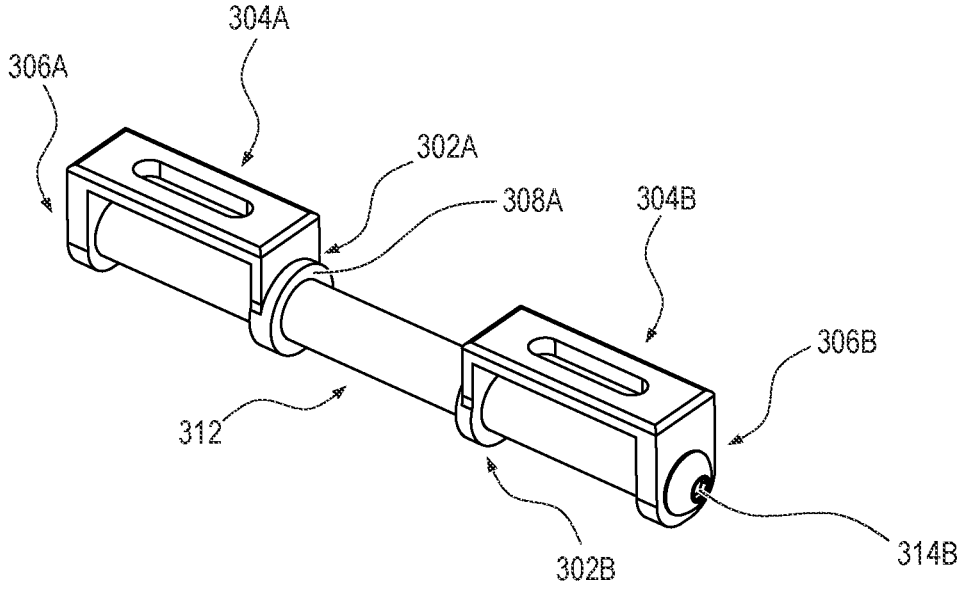
FIG. 3C is a perspective rear view of a set of the members on an axle for an archery bow, according to some embodiments.

FIG. 3C shows a set or pair of members 300A, 300B affixed or otherwise coupled to an axle 312. The first and second members 300A, 300B can be similar to, and can include some or all of the features of the members 126A, 126B, 200, 300. For example, each of the first and second members 300A, 300B can include respective shim portions 302A, 302B, intermediate portions 304A, 304B, and engagement portions 306A, 306B.

In some examples, the first member 300A can be coupled to the axle 312, for example, the shim portion 302A can act as a ring enveloping or encircling the axle 312. In some examples, the engagement portion 306A can additionally, or alternatively, facilitate coupling the first member 300A to the axle 312. For example, a fastener 314A can be inserted through a threaded aperture formed or defined within the axle 312 to removably affix the first member 300A to the axle 312. In some examples, the second member 300B can be coupled to the axle 312, for example, the shim portion 302B can act as a ring enveloping or encircling the axle 312. In some examples, the engagement portion 306B can additionally, or alternatively, facilitate coupling the second member 300B to the axle 312. For example, a fastener 314B can be inserted through a threaded aperture formed or defined within the axle 312 to removably affix the second member 300B to the axle 312.

Figure 3D:
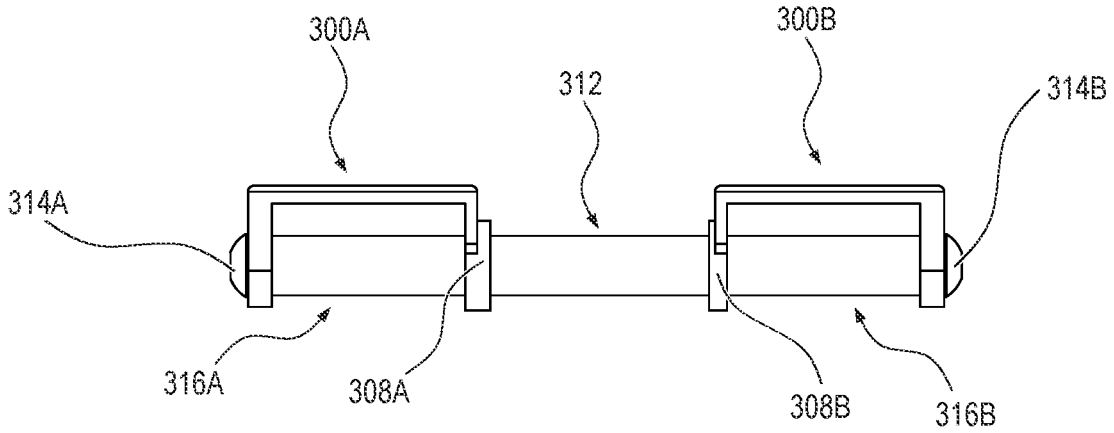
FIG. 3D is a rear view of the set of the members on the axle in a first configuration, according to some embodiments.

In some examples, the first and second members 300A, 300B can be swappable on the axle or otherwise repositioned on the axle 312 to vary a location a cam is retained on the axle 312 (e.g., between the first and second members 300A, 300B). By repositioning or swapping the first and second members 300A, 300B, the lean or tilt of the axle 312 exerted by the cam can be mitigated or modified to improve shooting characteristics of the archery bow. FIG. 3D shows the first and second members 300A, 300B in a first state or first configuration on the axle 312 wherein the first member 300A is coupled to a first side 316A of the axle 312 and the second member 300B is coupled to a second side 316B of the axle 312. In some examples, the first member 300A has a first spacing feature 308A having a first thickness and the second member 300B has a second spacing feature 308B having a second thickness different from the first thickness. In some examples, the first thickness can be less than about 0.015 inches, between about 0.015 inches and about 0.05 inches, between about 0.05 inches and about 0.1 inches, between about 0.1 inches and about 0.15 inches, or greater than 0.15 inches. In some examples, the second thickness can be less than about 0.015 inches, between about 0.015 inches and about 0.05 inches, between about 0.05 inches and about 0.1 inches, between about 0.1 inches and about 0.15 inches, or greater than 0.15 inches.

Figure 3E:
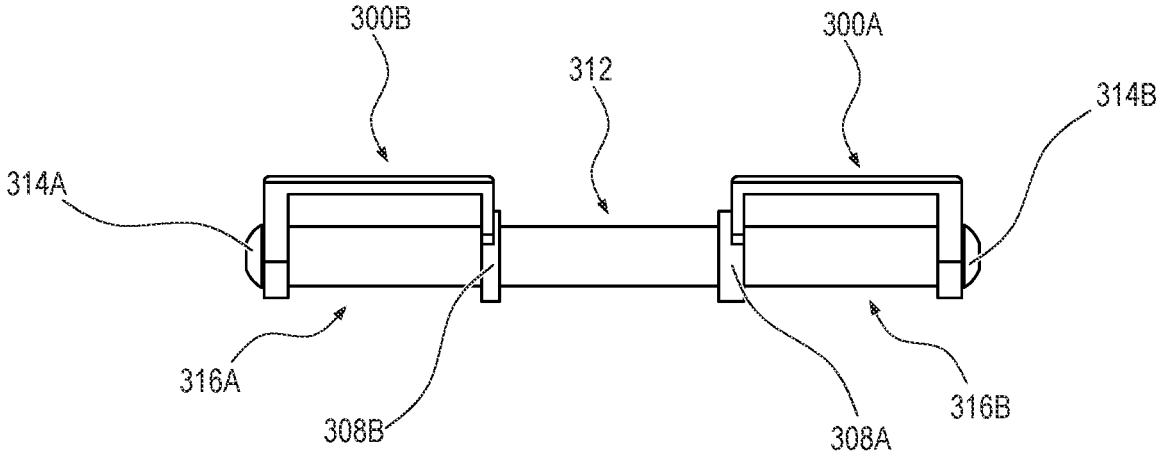
FIG. 3E is a rear view of the set of the members on the axle in a second configuration, according to some embodiments.

FIG. 3E shows the first and second members 300A, 300B in a second state or second configuration on the axle 312 wherein the first member 300A is coupled to the second side 316B of the axle 312 and the second member 300B is coupled to the first side 316A of the axle 312. Due to the relative difference between the first and second thicknesses of the first and second spacing features 308A, 308B, the cam can be disposed on the axle 312 at different lateral positions dependent on which sides 316A, 316B of the axle 312 the first and second members 300A, 300B are disposed (i.e., whether the members 300A, 300B are in the first configuration or second configuration). For example, in the first state or first configuration (see FIG. 3D) the cam can be disposed relatively closer to the second side 316B of the axle 312 because the relatively larger first spacing feature 308A of the first member 300A is spacing the cam further from the first side 316A of the axle 312. Conversely, in the second state or second configuration (see FIG. 3E) the cam can be disposed relatively further from the second side 316B of the axle 312 because the relatively thinner second spacing feature 308B of the second member 300B is spacing the cam further from the second side 316B of the axle 312.

Figure 4A:
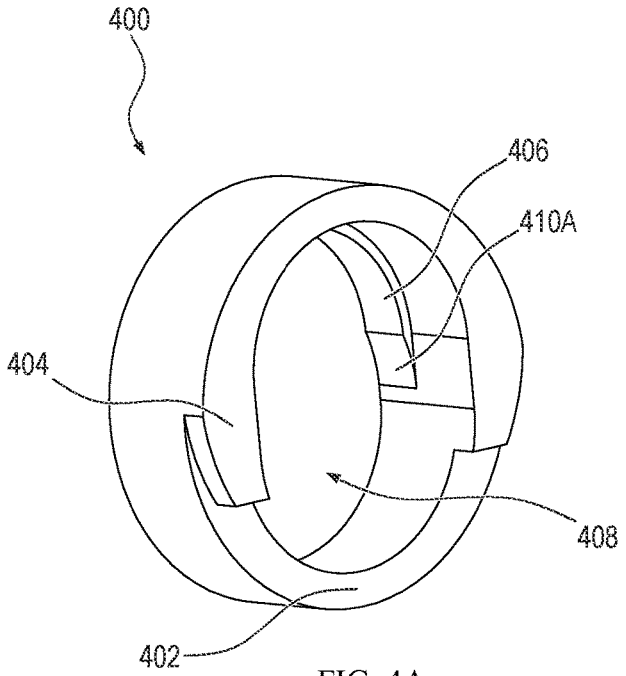
FIG. 4A is a perspective side view of a member for an archery bow, according to some embodiments.
Figure 4B:
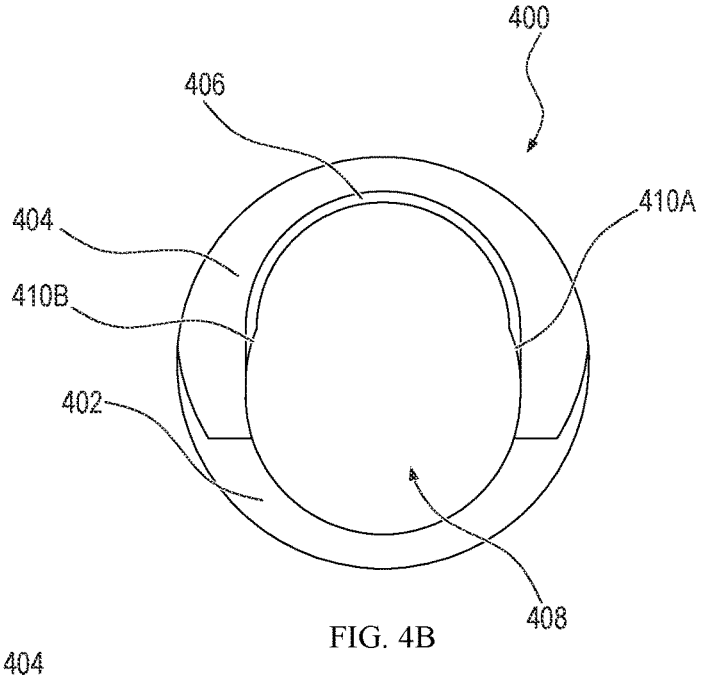
FIG. 4B is a side view of the member, according to some embodiments.
Figure 4C:
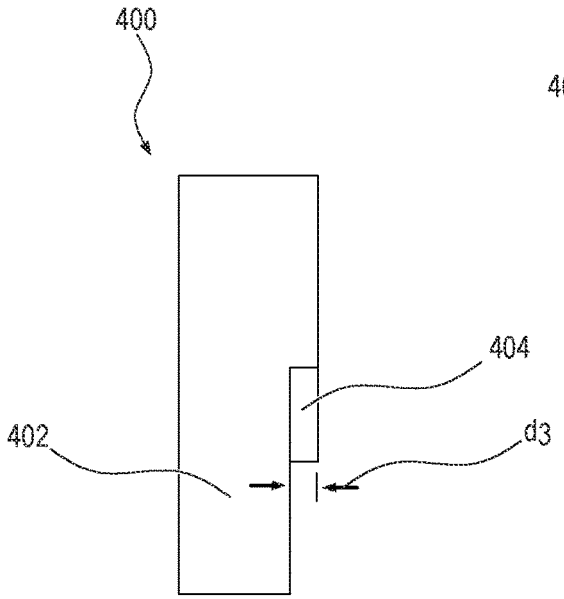
FIG. 4C is a rear view of the member, according to some embodiments.

FIGS. 4A-4C show another example of a member 400 disposable on an axle for an archery bow. The member 400 can include a main body 402, a shim portion 404, and a nesting feature 406. The main body 402 can be a circular or semicircular shape having an inner periphery defining an aperture or through-hole 408 (see FIG. 4B). In some examples, the main body 402 and the shim portion 404 can define the through-hole 408. The through-hole 408 can be sized and shaped such that an axle (e.g., the axle 312) can extend therethrough. In some examples, the through-hole 408 can be oblong such as an oval or other shape enabling the member 400 to be inserted onto an axle and thereafter slid or transitions such that the nesting feature 406 couples to one or more features of the axle (e.g., one or more channels or grooves 232A, 232B). An outer periphery of the main body 402 can be a circular or semicircular shape (see FIG. 4B). From the side, the member 400 can have a rectangular profile having two or more planar surfaces that extend substantially parallel to one another (see FIG. 4C).

The shim portion 404 can extend or protrude from the main body 402 by a distance $d_3$. The distance $d_3$ can vary in size to enable various lateral cam positions on the axle via spacing of the cam from the limb by the member 400. For example, the distance $d_3$ can be less than about 0.015 inches, between about 0.015 inches and about 0.05 inches, between about 0.05 inches and about 0.1 inches, between about 0.1 inches and about 0.15 inches, or greater than 0.15 inches. In some examples, the shim portion 404 can be disposed about an entire periphery of the main body 402 (e.g., disposed about an entirety of the periphery of the through-hole 408). In some examples, as shown in FIGS. 4A-4C, the shim portion 404 may be only disposed about a portion of the periphery of the main body 402 (e.g., disposed about a portion of the periphery of the through-hole 408). In some examples, the shim portion 404 is disposed about the main body 402 to engage an inner race of a cam bearing.

The nesting feature 406 can extend into the aperture 408 and at least partially encompass or encircle the aperture 408. In some examples, the nesting feature 406 can include one or more ramped or tapered sections 410A, 410B. The tapered sections 410A, 410B can ease or enable insertion of the nesting feature 406 within a slot or other feature on the axle (e.g., one or more channels or grooves 232A, 232B). A shape or contour of the nesting feature 406 can induce a snap fit or interlocking fit onto the axle and/or features of the axle. For example, the nesting feature 406 can be formed to extend beyond 180 degrees radially such that insertion onto the axle and/or features of the axle causes the nesting feature 406 to temporarily deform (e.g., causes the aperture 408 to temporarily widen) before returning to an original size and shape once installed on the axle. In other words, the nesting feature 406 can be sized such that a diameter of the axle is greater than or equal to an inner diameter of the aperture 408 defined by the nesting feature 406. This snap or interlocking fit between the axle and the member 400 can bias the member 400 from uncoupling from the axle while the archery bow is in use.

Figure 5A:
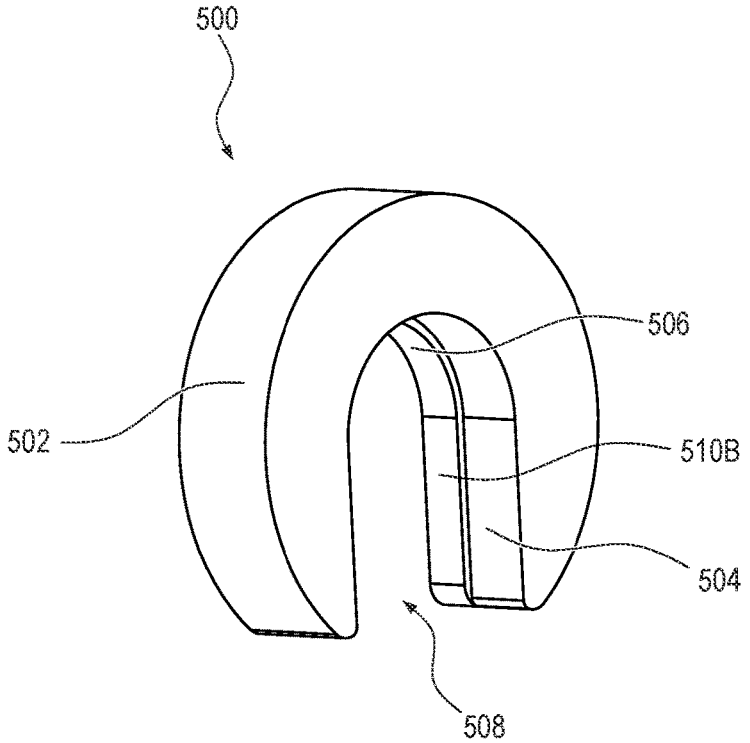
FIG. 5A is a perspective side view of a member on an axle for an archery bow, according to some embodiments.
Figure 5B:
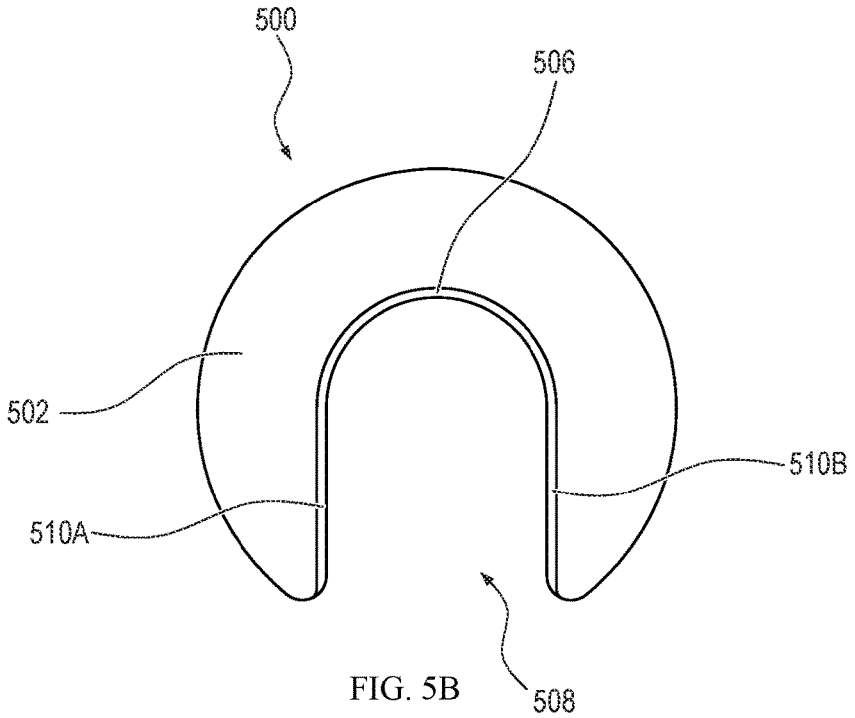
FIG. 5B is a side view of the member, according to some embodiments.

FIGS. 5A and 5B show another example of a member 500 disposable on an axle for an archery bow. The member 500 can include a main body 502, a shim portion 504, and a nesting feature 506. The main body 502 can be a circular or semicircular shape having an inner periphery defining an aperture or through-hole 508 (see FIG. 5B). In some examples, the main body 502 and the shim portion 504 can define the aperture 508. In some examples, the aperture 508 can be non-enclosed (e.g., u-shaped) such that the member 500 can be placed or disposed on the axle without removing or displacing one or more other components of the archery bow from the axle (e.g., a cam, a limb, a fastener, etc.). In other words, the member 500 can be coupled to the axle by engaging the axle in a direction that is perpendicular or substantially perpendicular to a longitudinal axis of the axle.

In some examples, as shown in FIGS. 5A and 5B, the main body 502 and shim portion 504 can be integrally formed and a thickness of the main body 502 can define a total thickness of the member 500. In other words, the main body 502 and the shim portion 504 can define a member 500 having a uniform thickness as opposed to the discontinuous thickness defined by the distance $d_3$ described herein with reference to the member 400 and shown in FIG. 4C. The nesting feature 506 can extend into the aperture 508 and at least partially encompass or encircle the aperture 508. In some examples, the nesting feature 506 can include one or more flat or planar sections 510A, 510B. The planar sections 510A, 510B can ease or enable insertion of the nesting feature 506 within and along a slot or other feature on the axle (e.g., one or more channels or grooves 232A, 232B) to couple the member 500 to the axle.

Figure 6A:
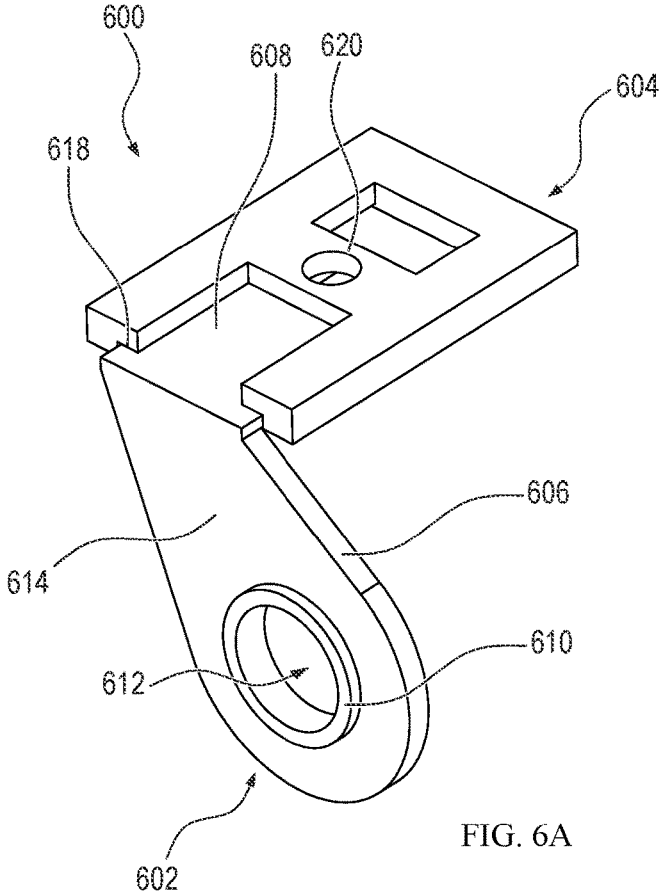
FIG. 6A is a perspective side view of a member for an archery bow, according to some embodiments.
Figure 6B:
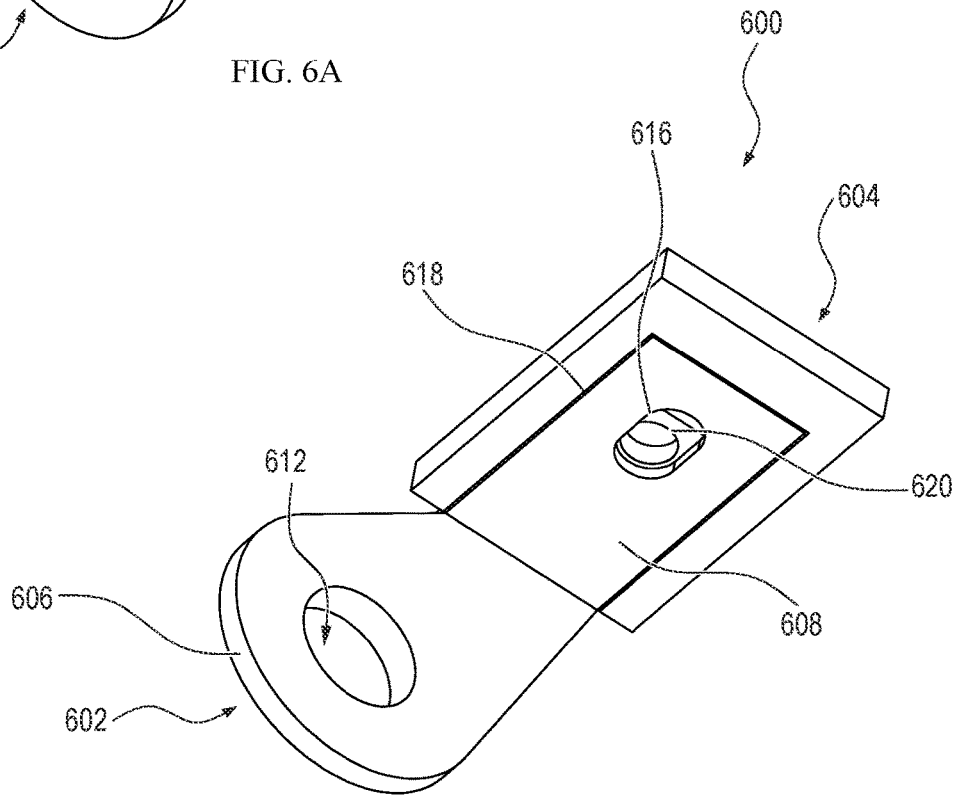
FIG. 6B is a perspective bottom view of the member, according to some embodiments.

FIG. 6A and FIG. 6B show a member 600 having a shim portion 602 that is adjustable or slidable relative to a mount portion 604. In some examples, the mount portion 604 can be coupled to a limb of an archery bow and the shim portion 602 can be repositioned relative to the mount portion 604 to vary or alter a distance a cam of the archery bow is disposed from the limb. The shim portion 602 can include a first segment 606 and a second segment 608. In some examples, the first segment 606 and the second segment 608 extend perpendicular or substantially perpendicular to one another. For example, the first segment 606 and the second segment 608 can form a right angle.

In some examples, the first segment 606 can include a spacing feature 610 disposed at least partially around an aperture 612. The spacing feature 610 can be arranged and positioned on the first segment 606 such that the spacing feature 610 is the only section of the shim portion 602 that contacts an inner race of a cam bearing leaving the remainder of the cam bearing to freely rotate about the axle. In some examples, as shown in FIG. 6A, the spacing feature 610 can define or form a portion of the first segment 606 that is relatively thicker or wider than the remainder of the first segment 606. In other words, the spacing feature 610 can extend or protrude from a lateral surface 614 of the first segment 606 to space or displace the cam from the lateral surface 614. The spacing feature 610 can be disposed about a portion of the first segment 606 located adjacent to an axle while the member 600 is affixed to the axle.

The second segment 608 can be at least partially coupled to the mount portion 604. For example, the mount portion 604 can form or define a recess and the second segment 608 can be at least partially disposed within the recess. In some examples, the second segment 608 can be disposed between the mount portion 604 and the limb when the member 600 is coupled to an archery bow. In some examples, the mount portion 604 can be disposed between the second segment 608 and the limb when the member 600 is coupled to the archery bow. In some examples, the second segment 608 can include a slot 616 such that a fastener (not shown) can be extended through the second segment 608 to couple the member 600 to the limb yet still enable the shim portion 602 to move relative to the mount portion 604. Alternatively, the slot 616 can be formed from a plurality of overlapping apertures machined or molded into the second segment 608.

The mount portion 604 can be coupled to one or more surfaces of the limb. For example, the mount portion 604 can be coupled to one or more of the tensile surface, compressive surface, and/or one of the lateral surfaces of the limb. The mount portion 604 can be coupled to one or more surfaces of the limb by a fastener, adhesive, or a combination thereof. The mount portion 604 can have an interlocking feature 618, such as, a slot, track, groove, protrusion, combination thereof, or other interlocking feature that engages the second segment 608 and enables the shim portion 602 to be slidable or moveable relative to the mount portion 604. For example, the interlocking feature 618 can form a dovetail or tracked engagement that enables the shim portion 602 to move linearly relatively to the mount portion 604, such as, from a first position to a second position. In some examples, one or both of the shim portion 602 and the mount portion 604 can include indicia or other markings to delineate a spacing or relative position the shim portion 602 is located relative to the mount portion 604. For example, one or both of the shim portion 602 and the mount portion 604 can include laser engraving hash marks on one or more surfaces of the member 600. In some examples, the mount portion 604 can include one or more apertures 620. In some examples, a fastener (not shown) can be extended through the aperture 620 and the slot 616 to couple the member 600 to an archery bow limb.

Figure 7A:
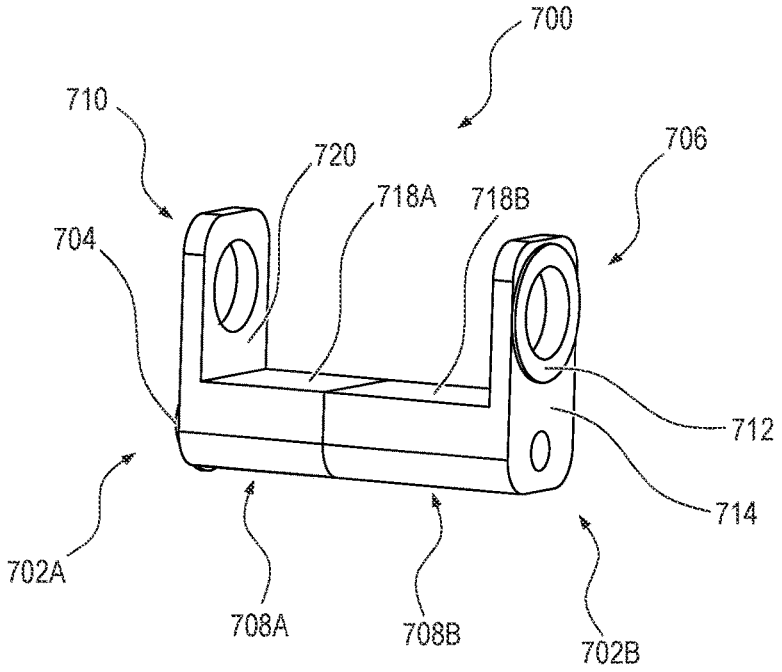
FIG. 7A is a perspective side view of a member for an archery bow in a first configuration, according to some embodiments.
Figure 7B:
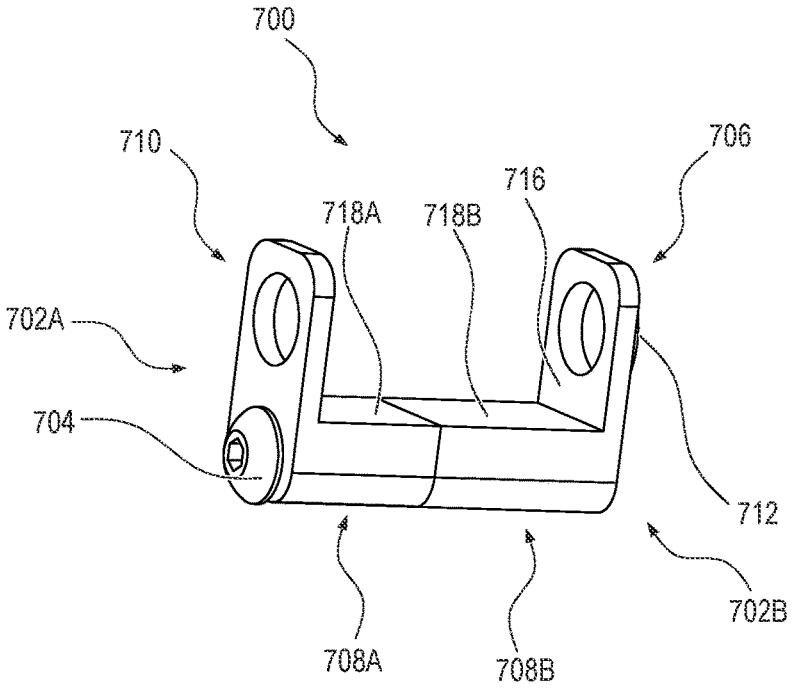
FIG. 7B is a perspective side view of the member in the first configuration, according to some embodiments.

FIGS. 7A and 7B show another example embodiment of a member 700 in a first configuration. The member 700 can be affixed to an axle and/or a limb of an archery bow to displace or locate a cam of the archery bow relative to the limb. In some examples, the member 700 can include two distinct halves 702A, 702B fastened together or otherwise coupled by a fastener 704. Each of the two halves 702A, 702B of the member 700 can include one or more portions, such as, a shim portion 706, first and second intermediate portions 708A and 708B, and/or an engagement portion 710. In some examples, one or more of these portions can be integrally formed from a continuous material, such as, a singular or unitary molded or machined component. In some examples, one or more of these portions can be discretely formed and thereafter welded, adhered, fastened, or otherwise coupled together to form the member 700.

Each of the portions (e.g., shim portion 706, intermediate portions 708A and 708B, and engagement portion 710) can be similar to, and can include some or all of the features of the portions (e.g., shim portions, intermediate portions, and engagement portions) of the members 126A, 126B, 200, 300, 400, 500, 600. For example, the shim portion 706 can include a spacing feature 712. The spacing feature 712 can be arranged and positioned on the shim portion 706 such that the spacing feature 712 is the only section of the shim portion 706 that contacts an inner race of a cam bearing leaving the remainder of the cam bearing to freely rotate about the axle. In some examples, the spacing feature 712 can define or form a section of the shim portion 706 that is relatively thicker or wider than a section of the shim portion 706 disposed adjacent the intermediate portion 708B. In other words, the spacing feature 712 can extend or protrude from a lateral surface 714 of the shim portion 706 to space or displace the cam from the lateral surface 714.

In some examples, each of the shim portion 706, the first and second intermediate portions 708A and 708B, and the engagement portion 710 can form or define respective limb-facing surfaces such that the member 700 includes multiple limb-facing surfaces. For example, the shim portion 706 can include a first surface or first limb-facing surface 716 and the first and second intermediate portions 708A and 708B can include respective second and third limb-facing surfaces 718A, 718B. In some examples, the first limb-facing surface 716 can be adjacent to and/or face a lateral surface of the limb (e.g., a side surface of the limb that is disposed closest to the cam). In some examples, the second and third limb-facing surfaces 718A and 718B can be adjacent to and/or face a tensile surface or compressive surface of the limb (e.g., a surface of the limb disposed between the lateral or side surfaces). In some examples wherein the member includes the engagement portion 710, the engagement portion 710 can form or define a fourth limb-facing surface 720. The fourth limb-facing surface 720 can be adjacent to and/or face a lateral surface of the limb (e.g., a side surface of the limb that is disposed furthest from the cam). Any combination of the first, second, third, or fourth limb-facing surfaces 716, 718A, 718B, 720 can extend perpendicular relative to one another.

Figure 7C:
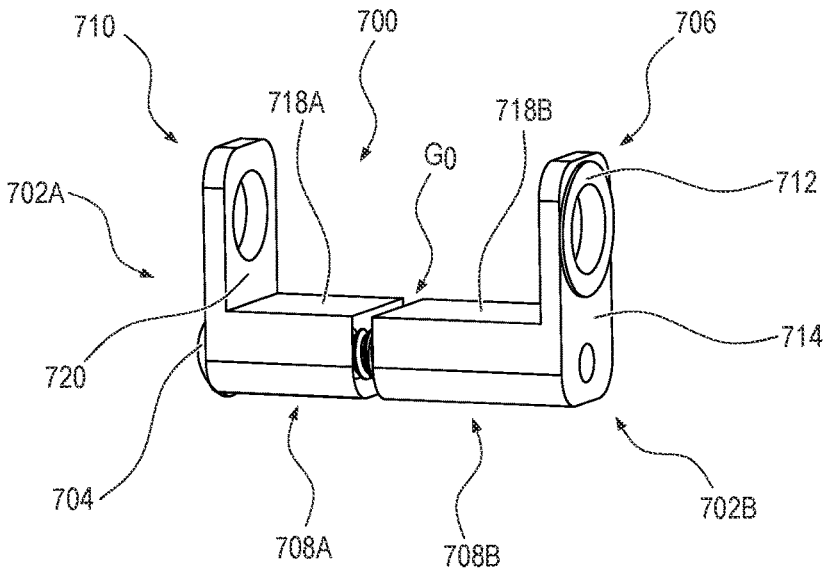
FIG. 7C is a perspective side view of the member for an archery bow in a second configuration, according to some embodiments.
Figure 7D:
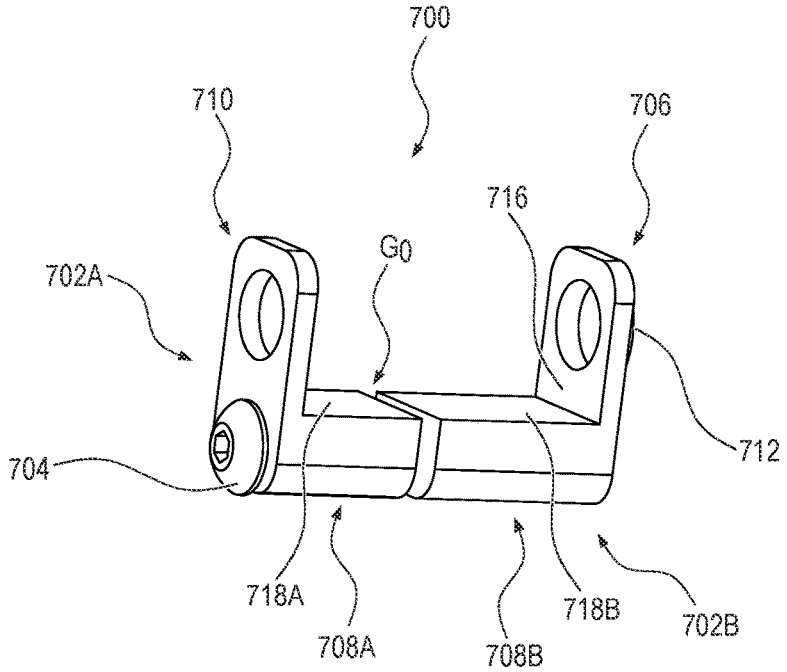
FIG. 7D is a perspective side view of the member in the second configuration, according to some embodiments.

FIGS. 7C and 7D show the member 700 in a second configuration wherein the two distinct halves 702A, 702B are displaced from one another. The two distinct halves 702A, 702B (i.e., first half 702A and second half 702B) can be repositionable relative to one another via the fastener 704. For example, the fastener 704 can be molded within or otherwise affixed to the first and/or second halves 702A, 702B such that rotation of the fastener 704 causes the first half 702A to move relative to the second half 702B or vice versa. In some examples, rotation of the fastener 704 can generate or form a gap $G_0$ between the first half 702A and the second half 702B. The gap $G_0$ can be representative of a distance the cam of the archery bow has been displaced from the limb of the archery bow. While only one member 700 is depicted, the archery bow can have more than one member 700 and each of the multiple members 700 can be adjustable via respective fasteners 704 to modify or manipulate a location of the cam on the axle.

FIGS. 8A-8E show another example of a set of members 800A, 800B. The members 800A, 800B can be affixed to respective ends of an axle 802 and/or one or more limbs (not shown, see e.g., limbs 104, 106) of an archery bow to displace or locate a cam 804 of the archery bow relative to the limb. See para. [00061]. The members 800A, 800B can be substantially similar to, and can include some or all of the features, of the member 700 described herein and shown in FIGS. 7A-7D. For example, the first member 800A can include two distinct halves 806A, 806B fastened together or otherwise coupled by a first fastener 808A and the second member 800B can include two distinct halves 810A, 810B fastened together or otherwise coupled by a second fastener 808B.

Each of the two halves 806A, 806B of the first member 800A can include one or more portions, such as, a shim portion 812A, first and second intermediate portions 814A and 816A, and/or an engagement portion 818A. Each of the two halves 810A, 810B of the second member 800B can include one or more portions, such as, a shim portion 812B, first and second intermediate portions 814B and 816B, and/or an engagement portion 818B. Each of the one or more portions of each of the members 800A, 800B can function as the one or more portions of the member 700 described herein within reference to FIGS. 7A-7D. For example, as shown in FIG. 8C, the respective shim portions 812A, 812B can have respective spacing features 820A, 820B contacting respective inner races 822A, 822B of the cam bearings 824A, 824B.

Figure 8A:
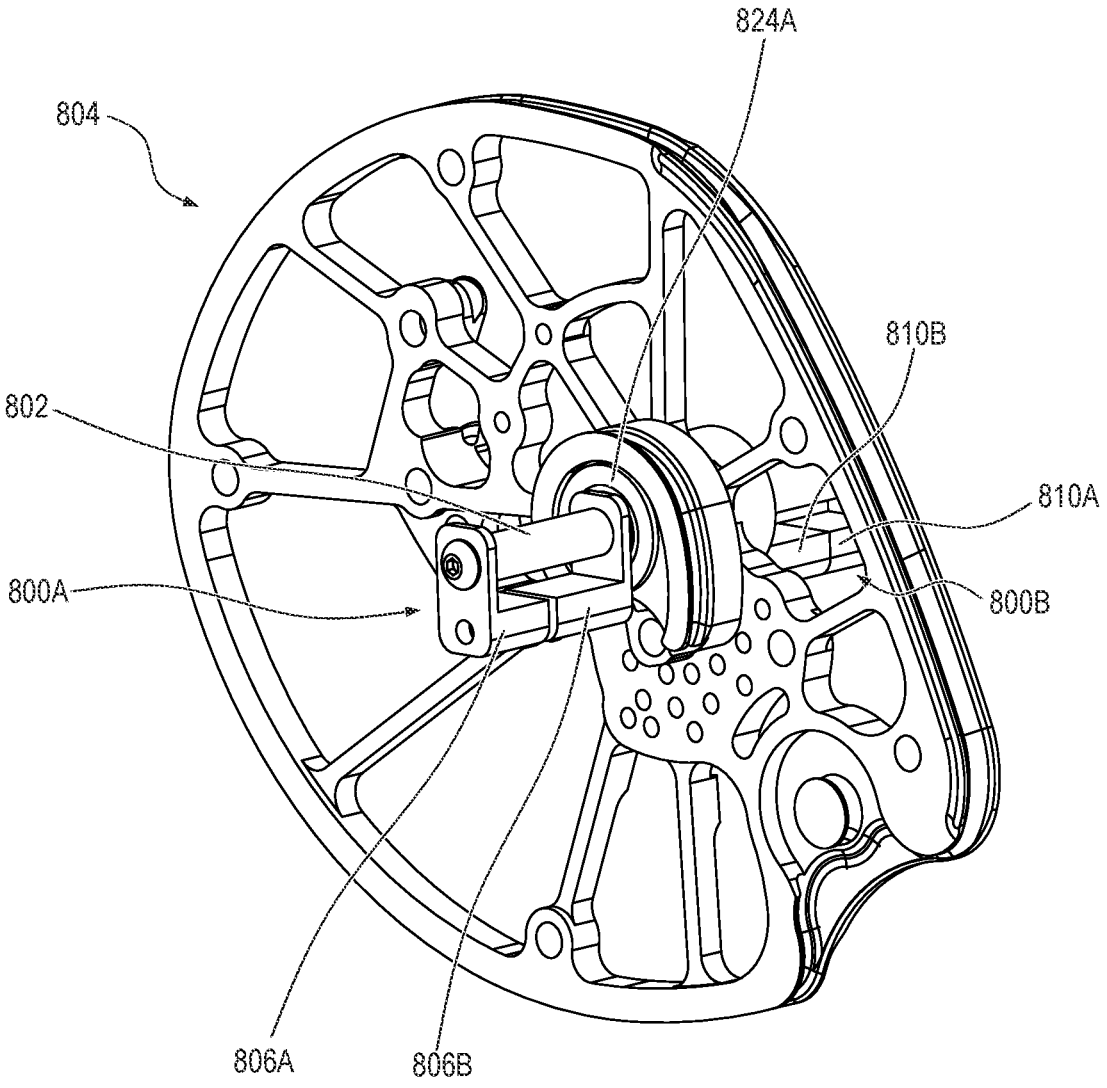
FIG. 8A is a perspective side view of a member, an axle, and a cam for an archery bow, according to some embodiments.
Figure 8B:
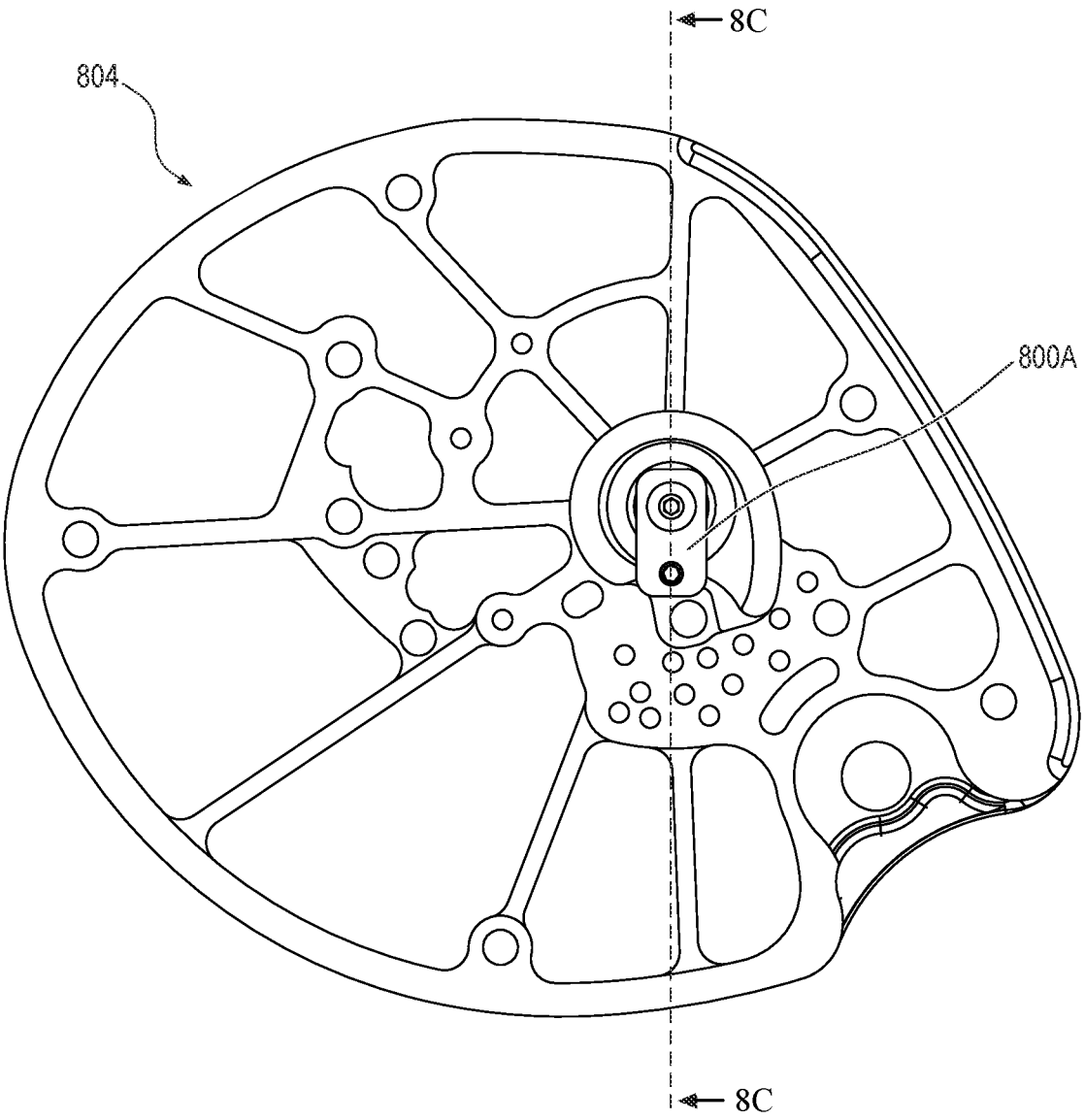
FIG. 8B is a side view of the member, the axle, and the cam, according to some embodiments.
Figure 8C:
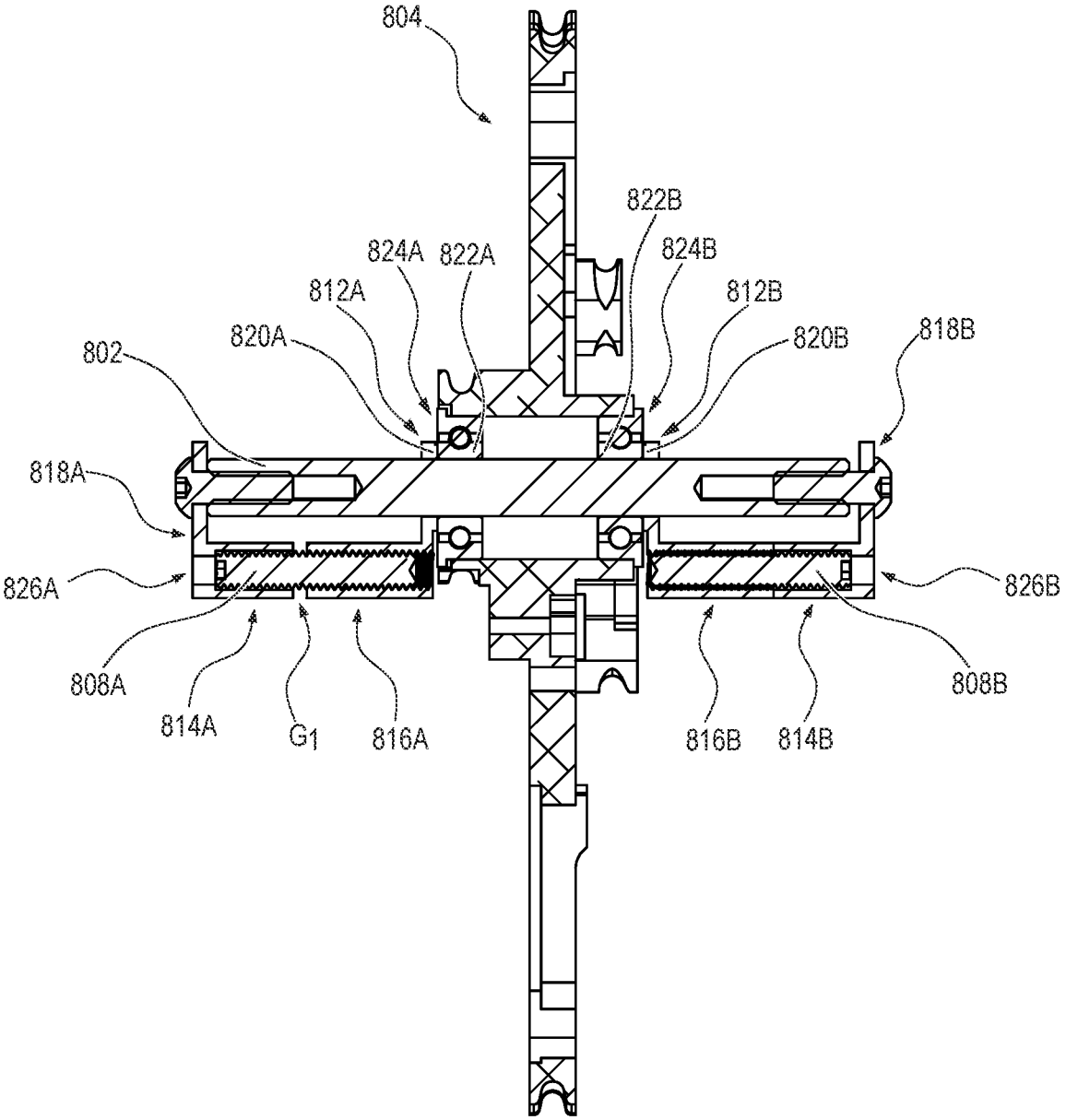
FIG. 8C is a cross-section rear view through the section line 8C-8C shown in FIG. 8B.

FIG. 8C shows a cross-sectional view of the members 800A and 800B, the axle 802, and the cam 804 through section line 8C-8C shown in FIG. 8B. Each of the members 800A, 800B can be reconfigurable or repositionable between one or more configurations. In some examples, the first member 800A can be in a configuration wherein the two halves 806A, 806B are spaced apart to form a gap $G_1$ (see FIG. 8C and FIGS. 8A, 8C, and 8D). In some examples, a rotational position of the first fastener 808A can dictate the size of the gap $G_1$. For example, a threaded engagement between the first fastener 808A and the two halves 806A, 806B can cause the two halves 806A, 806B to move relative to one another to form the gap $G_1$ when the first fastener

808A is rotated. In some examples, the engagement portion 818A can include an aperture 826A that enables insertion of a tool or other device to engage and rotate the first fastener 808A. Additionally, or alternatively, the second member 800B can be in a configuration wherein the two halves 810A, 810B are spaced apart to form a gap $G_2$ (see FIG. 8E). In some examples, rotating the second fastener 808B can dictate the size of the gap $G_2$. For example, a threaded engagement between the second fastener 808B and the two halves 810A, 810B can cause the two halves 810A, 810B to move relative to one another to form the gap $G_2$ when the second fastener 808B is rotated. In some examples, the engagement portion 818B can include an aperture 826B that enables insertion of a tool or other device to engage and rotate the second fastener 808B.

Figure 8D:
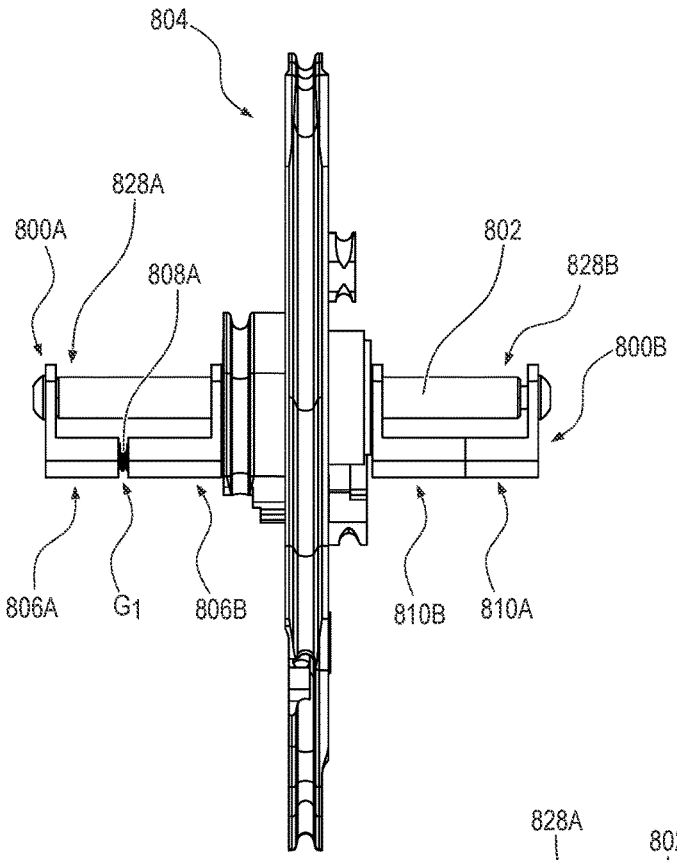
FIG. 8D is a rear view of the member, the axle, and the cam in a first configuration, according to some embodiments.
Figure 8E:
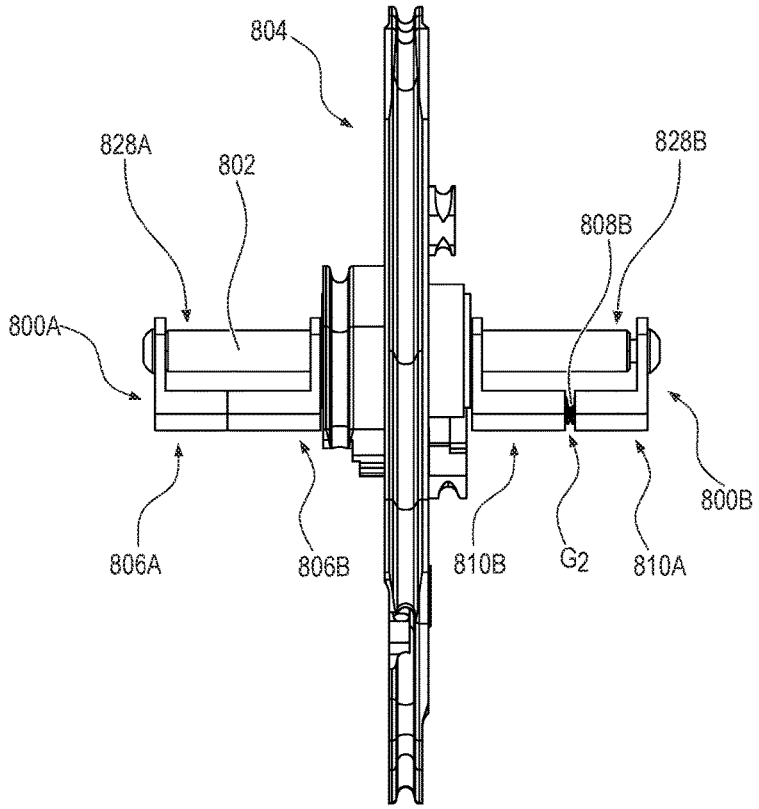
FIG. 8E is a rear view of the member, the axle, and the cam in a second configuration, according to some embodiments.

FIG. 8D shows the set of members 800A, 800B in a first configuration wherein the first member 800A is modified to form the gap $G_1$ between the two halves 806A, 806B. In the first configuration, the first member 800A can bias the cam 804 to be disposed or located on the axle 802 relatively further from a first end 828A of the axle 802 and closer to a second end 828B of the axle 802. The first member 800A can be disposed adjacent the first end 828A of the axle 802. The second member 800B can be disposed adjacent the second end 828B of the axle 802. FIG. 8E shows the set of members 800A, 800B in a second configuration wherein the second member 800B is modified to form the gap $G_2$ between the two halves 810A, 810B. In the second configuration, the second member 800B can bias the cam 804 to be disposed or located on the axle 802 relatively closer to the first end 828A of the axle 802 and further from the second end 828B of the axle 802. While FIG. 8D and FIG. 8E show the members 800A, 800B in first and second configurations, respectively, the members 800A, 800B can additionally, or alternatively, be adjusted or modified (e.g., via the first and second fasteners 808A, 808B) such that both the members 800A, 800B each have respective gaps (e.g., gaps $G_1$, $G_2$) at the same time. In other words, each of the members 800A, 800B can be independently micro-adjustable (e.g., via the first and second fasteners 808A, 808B) such that the first and second configurations define outer bounds of a spectrum of many possible configurations resulting in a spectrum of many differing locations/positions of the cam 804 on the axle 802.

In some examples, changes may be made in the function and arrangement of archery components or products discussed without departing from the spirit and scope of the disclosure, and various embodiments may omit, substitute, or add other components or accessories as appropriate. For instance, one or more portions incorporated into a particular component described with respect to certain embodiments may be combined in other embodiments.

Various aspects have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed:

1. An archery bow, comprising:
a riser;
a limb extending from the riser;
a cam rotatably coupled to the limb by an axle;
a member contacting the axle, the member having a shim portion positioning the cam a distance from the limb, the member defining a first surface facing the limb and a second surface facing the limb, the first surface different from the second surface; and
a fastener coupling the second surface to a tensile surface or a compressive surface of the limb.

2. The archery bow of claim 1, wherein the first surface faces a lateral surface of the limb and the second surface faces a tensile surface or a compressive surface of the limb.

3. The archery bow of claim 1, wherein the first surface extends perpendicularly relative to the second surface.

4. The archery bow of claim 1, wherein the axle includes a groove and a portion of the member is disposed within the groove.

5. The archery bow of claim 1, wherein:
the member defines a first end contacting the axle at a first location;
the member defines a second end contacting the axle at a second location; and
the first location is spaced a distance from the second location along a length of the axle.

6. The archery bow of claim 5, wherein the distance is at least equivalent to a width of the limb.

7. An archery bow, comprising:
a riser;
a limb extending from the riser;
a cam rotatably coupled to the limb by an axle; and
a member contacting the axle, the member having a shim portion positioning the cam a distance from the limb, the member defining a first surface facing the limb and a second surface facing the limb, the first surface different from the second surface; wherein:
the member includes a mount portion coupled to the limb; and
the shim portion is repositionable relative to the mount portion.

8. The archery bow of claim 7, wherein the limb is a first limb and the member is a first member having a first shim portion, the archery bow further comprising:
a second limb extending from the riser; and
a second member contacting the axle, the second member having a second shim portion displacing the cam a distance from the second limb, the second member defining a third surface facing the second limb and a fourth surface facing the second limb, the third surface different from the fourth surface.

9. The archery bow of claim 8, wherein the first shim portion has a first thickness and the second shim portion has a second thickness less than the first thickness.

10. An archery bow comprising:
a riser;
a limb extending from the riser;
an axle coupled to the limb, the axle having a groove disposed between a first end and a second end of the axle;
a cam rotatable about the axle; and
a member contacting the axle, the member disposed between the cam and the limb and comprising:
a main body;
a shim portion; and
a nesting feature received within the groove.

11. The archery bow of claim 10, wherein:
the main body has a first thickness;
the shim portion has a second thickness; and a maximum thickness of the member is defined by a summation of the first thickness and the second thickness.

12. The archery bow of claim 10, wherein the groove extends around a circumference of the axle.

13. The archery bow of claim 10, wherein the nesting feature is disposed within an aperture defined by the main body.

* * * * *